US007269263B2

(12) United States Patent
Dedieu et al.

(10) Patent No.: US 7,269,263 B2
(45) Date of Patent: Sep. 11, 2007

(54) METHOD OF BROADBAND CONSTANT DIRECTIVITY BEAMFORMING FOR NON LINEAR AND NON AXI-SYMMETRIC SENSOR ARRAYS EMBEDDED IN AN OBSTACLE

(75) Inventors: Stephane Dedieu, Ottawa (CA); Philippe Moquin, Ottawa (CA)

(73) Assignee: BNY Trust Company of Canada, Ottawa Ontario (CA)

( * ) Notice: Subject to any disclaimer, the term of this patent is extended or adjusted under 35 U.S.C. 154(b) by 811 days.

(21) Appl. No.: 10/732,283

(22) Filed: Dec. 11, 2003

(65) Prior Publication Data

US 2004/0120532 A1 Jun. 24, 2004

(30) Foreign Application Priority Data

Dec. 12, 2002 (GB) ..... 0229059.1

(51) Int. Cl.
*H04R 3/00* (2006.01)

(52) U.S. Cl. ..... 381/92; 381/91

(58) Field of Classification Search ..... 381/92, 381/160, 356, 122, 91
See application file for complete search history.

(56) References Cited

U.S. PATENT DOCUMENTS 5,592,441 A * 1/1997 Kuhn ..... 367/153
6,041,127 A * 3/2000 Elko ..... 381/92
7,068,801 B1 * 6/2006 Stinson et al. ..... 381/160
2003/0072460 A1 * 4/2003 Gonopolskiy et al. ..... 381/92
2003/0147539 A1 * 8/2003 Elko et al. ..... 381/92

FOREIGN PATENT DOCUMENTS

CA 2292357 12/1999
WO WO 02/058432 A 7/2002

OTHER PUBLICATIONS

Feng Qian and Barry D. Van Veen, "Quadratically Constrained Adaptive Beamforming for Coherent Signals and inteference",Aug. 1995,IEEE,vol. 43, No. 8.*
Solw Yong Low et al, "Robust Microphone Array Using Subband Adaptive Beamformer and Spectral Subtraction", 8th Int. Conf. Communications Systems, 2002 (ICCS 2002), vol. 2, pp. 1020-1024.
Yermeche et al, "A Calibrated Subband Beamforming Algorithm for Speech Enhancement", Sensor Array & Multichannel Signal Porcess Workshop Proceedings, 2002, pp. 485-489.

(Continued)

*Primary Examiner*—Vivian Chin
(74) *Attorney, Agent, or Firm*—Antonelli, Terry, Stout & Kraus, LLP.

(57) ABSTRACT

A method is provided for designing a broad band constant directivity beamformer for a non-linear and non-axi-symmetric sensor array embedded in an obstacle having an odd shape, where the shape is imposed by industrial design constraints. In particular, the method of the present invention provides for collecting the beam pattern and keeping the main lobe reasonably constant by combined variation of the main lobe with the look direction angle and frequency. The invention is particularly useful for microphone arrays embedded in telephone sets but can be extended to other types of sensors.

15 Claims, 23 Drawing Sheets

OTHER PUBLICATIONS

A. Ishimaru, "*Theory of Unequally Sapced Arrays*", IRE Trans Antenna and Propagation, vol. AP-10, pp. 691-702, Nov. 1962.

Jens Meyer, "*Beamforming for a Circular Microphone Array Mounted on Spherically Shaped Objects*", Journal of the Acoustical Society of America 109(1), Jan. 2001, pp. 185-193.

Marc Anciant, "Modélisation du Champ Acoustique Incident au Décollage de las Fusée Ariane", Jul. 1996, ph.D. Thesis, Universite de Technologie de Compiegne, France, pp. 18-45.

P. J. Kootsookos, D. B. Ward, R. C. Williamson, "*Imposing Pattern Nulls on Broadband Array Responses*", Journal of the Acoustical Society of America 105 (Jun. 6, 1999), pp. 3390-3398.

Henry Cox, Robert Zeskind, Mark Owen, "*Robust Adaptive Beamforming*", IEEE Trans. On Acoustics, Speech, and Signal Processing, vol. ASSP-35, No. 10 Oct. 1987, pp. 1365-1376.

Feng Qian "*Quadratically Constrained Adaptive Beamforming for Coherent Signals and Interference*", IEEE Trans. On Signal Proc., vol. 43, No. 8, Aug. 1995, pp. 1890-1900.

Zhi Tian, K. Bell, H.L. Van Trees, "*A Recursive Least Squares Implementation for LCMP Beamforming Under Quadratic Constraint*", IEEE Trans. On Signal Processing, vol. 49, No. 6, Jun. 2001, pp. 1138-1145.

O. L. Frost, "*An Algorithm for Linearly Constrained Adaptive Array Processing*", Proceedings IEEE, vol. 60, No. 8, Aug. 1972, pp. 926-935.

J. Lardies, "*Acoustic Ring Array with Constant Beamwidth Over a Very Wide Frequency Range*", Acoustics Letters, vol. 13, No. 5, pp. 77-81, Nov. 1989.

M. F. Berger and H.F. Silerman, "*Microphone Array Optimization by Stochastic Region Contraction*", IEEE Trans. Signal Processing, vol. 39, No. 11, pp. 2377-2386, Nov. 1991.

F. Pirz, "*Design of a Wideband, Constant Beamwidth Array Microphone for Use in the Near Field*", Bell Systems Technical Journal, vol. 58, No. 8, Oct. 1979, pp. 1839-1850.

D. Ward, R. A. Kennedy, R. C. Williamson, "Theory and Design of Broadband Sensor Arrays with Frequency Invariant Far-Field Beam-Patterns", Journal of The Acoustical Society of America, vol. 97(2), Feb. 1995, pp. 1023-1034.

M. I. Skolnik, "*Non Uniform Arrays*", in "Antenna Theory", Pt. 1, edited by R.E. Collin and F. Jzucker (McGrawHill, New-York, 1969), Chap. 6, pp. 207-279 (pp. 207-233 enclosed).

A.C.C. Warnock & W. T. Chu, "*Voice and Background Noise Levels Measured in Open Offices*", IRC Internal Report IR-837, Jan. 2002 (20 pgs.).

Morse and Ingard, "*Theoretical Acoustics*", Princeton University Press, 1968, pp. 332-425.

Michael Brandstein, Darren Ward, "*Microphone Arrays*" Signal Processing Techniques and Applications, Springer, 2001 (pp. 21-38).

* cited by examiner

Superdirective

Constrained

METHOD OF BROADBAND CONSTANT DIRECTIVITY BEAMFORMING FOR NON LINEAR AND NON AXI-SYMMETRIC SENSOR ARRAYS EMBEDDED IN AN OBSTACLE

FIELD OF THE INVENTION

The invention relates generally to microphone arrays, and more particularly to a method for correcting the beam pattern and beamwidth of a microphone array embedded in an obstacle whose shape is not axi-symmetric.

BACKGROUND OF THE INVENTION

Sensor arrays are known in the art for spatially sampling wave fronts at a given frequency. The most obvious application is a microphone array embedded in a telephone set, to provide conference call functionality. In order to avoid spatial sampling aliasing, the distance, d, between sensors must be lower than $\lambda/2$ where $\lambda$ is the wavelength.

Many publications are available on the subject of sensor arrays, including:

[1] A. Ishimaru, "*Theory of unequally spaced arrays*", IRE Trans Antenna and Propagation, vol. AP-10, pp.691-702, November 1962

[2] Jens Meyer, "*Beamforming for a circular microphone array mounted on spherically shaped objects*", Journal of the Acoustical Society of America 109 (1), January 2001, pp. 185-193.

[3] Marc Anciant, "*Modélisation du champ acoustique incident au décollage de la fusée Ariane*", July 1996, Ph.D. Thesis, Université de Technologie de Compiègne, France.

[4] Michael Stinson, James Ryan, "*Microphone array diffracting structure*", Canadian Patent Application 2,292, 357.

[5] P. J. Kootsookos, D. B. Ward, R. C. Williamson, "*Imposing pattern nulls on broadband array responses*", Journal of the Acoustical Society of America 105 (6, June 1999, pp. 3390-3398.

[6] Henry Cox, Robert Zeskind, Mark Owen, "*Robust Adaptive Beamforming*", IEEE Trans. on Acoustics, Speech, and Signal Processing, Vol. ASSP-35, No. 10 October 1987, pp.1365-1376

[7] Feng Qian "*Quadratically Constrained Adaptive Beamforming for Coherent Signals and Inteference*", IEEE Trans. On Signal Proc. Vol.43 No.8 August 1995, pp.1890-1900

[8] Zhi Tian, K. Bell, H. L. Van Trees "*A Recursive Least Squares Implementation for LCMP Beamforming Under Quadratic Constraint*", IEEE Trans. On Signal Processing, Vol. 49, No. 6, June 2001, pp.1138-1145

[9] O. L. Frost, "*An algorithm for linearly constrained adaptive array processing*", Proceedings IEEE, vol. 60, pp. 926-935, august 1972.

[10] J. Lardies, "*Acoustic ring array with constant beamwidth over a very wide frequency range*", Acoustics Letters, vol. 13, pp. 77-81, November 1989.

[11] M. F. Berger and H. F. Silverman, "*Microphone array optimization by stochastic region contraction*", IEEE Trans, Signal Processing", vol. 39, pp.2377-2386, November 1991.

[12] F. Pirz, "*Design of a wideband, constant beamwidth array microphone for use in the near field*", Bell Systems Technical Journal, vol. 58, pp. 1839-1850, October 1979.

[13] D. Ward, R. A. Kennedy, R. C. Williamson, "*Theory and design of broadband sensor arrays with frequency invariant far-field beam-patterns*", Journal of The Acoustical Society of America, vol. 97, pp. 1023-1034, February 1995.

[14] Gary Elko, "*A steerable and variable first-order differential microphone array*", U.S. Pat. No. 6,041,127, Mar. 21, 2000.

[15] M. I. Skolnik "*Non uniform arrays*", in "Antenna Theory", Pt. 1, edited by R. E. Collin and F. Jzucker (Mc GrawHill, New-York, 1969), Chap. 6, pp. 207-279

[16] A. C. C. Warnock & W. T. Chu, "*Voice and Background noise levels measured in open offices*", IRC Internal Report IR-837, January 2002.

[17] Morse and Ingard, "Theoretical Acoustics", Princeton University Press, 1968.

[18] Michael Brandstein, Darren. Ward, "Microphone arrays", Springer, 2001.

For free-field linear, circular, or non-linear arrays, Ishimaru [1] discusses the issues of constant inter sensor spacing and non-constant inter-sensor spacing.

Meyer [2] discloses arrays embedded in a diffracting obstacle of simple shape, and provides an analytical solution for the wave equation in acoustics. For arrays of simple shape like circular rings embedded in a more complex shape, for which there is no analytical solution of the wave equation, Anciant [3] and Ryan [4] make use of numerical methods, such as Boundary Element methods (BEM) or Finite or Infinite Elements methods (FEM, IFEM).

Most of the literature describes broadband frequency invariant beamforming for circular arrays or linear arrays, but not for microphone arrays in shapes that are not symmetric or axi-symmetric. One example of such an obstacle whose shape is dictated by industrial design constraints resulting in an odd shape, is a telephone incorporating a microphone array. The problem of beamforming with such an array is quite different from that dealt with in the literature since the solution relies on constrained optimisation, with a constraint build using a set of vectors containing the sensor signal for acoustic waves with specific directions of arrival.

In that regard, the following prior art is relevant:

P. Kootssokos [5] proposes a technique intended for rejecting a far-field broadband signal from a given known direction by imposing pattern nulls on broadband array responses. The method consists of generating deep and wide "null" or quiescent areas in given directions. This is achieved by imposing a set of linear constraints.

Henry Cox [6] proposes robust adaptive beamforming by the use of different sets of constraints. The constraints, quadratic and linear, are used to make the beamformer more robust to small errors of sensor amplitude, phase or position.

Feng Qian [7] proposes a quadratically constrained adaptive beamforming technique, but deals only with coherent interfering signals.

In Zhi Tian, K Bell, H. L. Van Trees [8], LCMP beamforming is set forth under quadratic constraints to provide an adaptive beamformer, but is concerned only with the stability of convergence.

Although a number of the methods discussed in the above-referenced prior art use specific vectors to shape the beam they, do not deal with the consequences of non-linear or non axi-symmetric arrays on the beampatterns and the resultant possible loss of "look" direction.

The following prior art relates more specifically to beamforming with constant broadband frequency invariant beamwidth, but not in relation to non axi-symmetric or non-linear arrays:

Frost [9] sets forth an adaptive array with M sensors to produce M constraints on the beam pattern of the array at a single frequency. The author proposes an algorithm for linearly constrained adaptive array processing. A set of linear constraints is introduced to provide an adaptive process in order to build a super directive array. Although this method can produce a constant beam pattern or null in given directions at various frequencies it is not designed to produce an identical beam pattern over a continuous frequency band and for various azimuth angle when the array is "asymmetric".

Lardies [10] proposes an acoustic multiple ring array with constant beamwidth over a very wide frequency range. To determine the unknown filter function, a linear constraint is imposed at an angle $\theta_H$ corresponding to the half-power beam angle. This procedure is intended to generate a constant beam over a band of frequencies, but is limited to symmetrical free-field arrays.

Berger and Silverman [11] disclose another approach consisting of designing the broadband sensor array by determining sensor gains and inter-sensor spacing as a multidimensional optimisation problem. This method does not use frequency dependant array sensor gains but attempts to find optimal spacing and fixed gains by minimising the array power spectral density over a given frequency band Pirz [12] uses harmonic nesting, in which the array is composed of several sets of sub-arrays with different inter-sensor spacings adapted for different frequency ranges. It should be noted that lowering the inter-sensor spacing under $\lambda/2$ only provides redundant information and directly conflicts with the desire to have as much aperture as possible for a fixed number of sensors.

Ishimaru [1] uses the asymptotic theory of unequally spaced arrays to derive relationships between beam pattern properties (peal response, main lobe width, . . . ) and array design. These relationships are then used to translate beam pattern requirements into functional requirements on the sensor spacing and weighting, thereby deriving a constant broadband design.

The prior art culminates with Ward [13] who finds a more general solution for providing the best possible broadband frequency invariant beam pattern. Ward considers a broadband array with constant beam pattern in the far field. Again, the asymptotic theory of unequally spaced arrays is used to derive relationships between beam pattern properties such as main lobe width, peak response, and array design. These relationships are expressed versus sensor spacing and weightings and Ward uses an ideal continuous sensor that is then "discretised" in an optimal array of point sensors, giving constant broadband beamwidth.

The following prior art relates to arrays embedded in obstacles:

The benefit of an obstacle for a microphone array in terms of directivity and localisation of the source or multiple sources is discussed in Marc Anciant [4]. Anciant describes the "shadow" area induced by an obstacle for a 3D-microphone array around a mock-up of the Ariane IV launcher in detecting and characterising the engine noise sources at takeoff.

Meyer [2] uses the concept of phase mode to generate a desired beam pattern from a circular array embedded in a rigid sphere, taking advantage of the analytical expression of the pressure diffracted by such an obstacle. He describes the benefit of the obstacle in term of broadband performance and noise susceptibility improvement Elko [14] uses a small sphere with microphone dipoles in order to increase wave-travelling time from one microphone to another and thus achieve better performance in terms of directivity. A sphere is used since it allows for analytical expressions of the pressure field generated by the source and diffracted by the obstacle. The computation of the pressure at various points on the sphere allows the computation of each microphone signal weight.

Jim Ryan et al [4] extend this idea to circular microphone arrays embedded in obstacles with more complex shapes using a super-directive approach and a boundary element method to compute the pressure field diffracted by the obstacle. Emphasis is placed on the low frequency end, to achieve strong directivity with a small obstacle and a specific impedance treatment for allowing air-coupled surface waves to occur. This treatment results in increasing the wave travel time from one microphone to another thereby increasing the "apparent" size of the obstacle for better directivity in the low frequency end. Ryan et al. have shown that using an obstacle improves directivity in the low frequency domain, compared to the same array in free field.

Skolnik [15] is noteworthy for teaching that error occurs when the position of the array sensors are subject to variation, and by extension that this error can be applied to non-uniform arrays.

Except for Anciant and Ryan, none of the techniques described in the prior art can be used when the sensor array is embedded in an obstacle with an odd shape, in the presence of a rigid plane for example, either with or without an acoustic impedance condition on its surface. Numerical methods are required. As they do not give an analytical expression of the pressure field at the sensor vs. frequency, the techniques proposed by most of the above-referenced authors (except Anciant and Ryan) can not be used. None of the prior art deals with or describes variation of the beam pattern in such conditions. It should be noted that Anciant and Ryan deal with circular arrays only, and do not deal with constant beamwidth or any other problem linked to frequency variation and array geometry properties.

SUMMARY OF THE INVENTION

According to the present invention, a method is provided for designing a broad band constant directivity beamformer for a non-linear and non-axi-symmetric sensor array embedded in an obstacle having an odd shape (such as a telephone set) where the shape is imposed, for example, by industrial design constraints. In particular, the method of the present invention corrects beam pattern asymmetry and keeps the main lobe reasonably constant over a range of frequencies and for different look direction angles. The invention prevents the loss of "look direction" resulting from a strong beampattern asymmetry for certain applications. The invention is particularly useful for microphone arrays but can be extended to other types of sensors. In fact, the method of the present invention may be applied to any shape of body that can be modelled with FEM/BEM and that is physically realisable.

First, a numerical method such as Boundary Element Method (BEM), Finite or Infinite Elements Method (FEM or IFEM) is applied to the body taking into account a rigid plane and, in one embodiment, acoustic impedance conditions on the surface of the body. Sensors of the array are positioned at selected nodes of the boundary element mesh. A set of potential sources to be detected is defined and modelled as monopoles, and the acoustic pressure (phase and magnitude) is determined at every sensor for each source. It should be noted that the use of acoustic monopoles is not restrictive. Plane Wave or any other source that can be modelled using Numerical Methods can be used (source in an obstacle to reproduce the mouth/head, radiating structure, etc.).

The second step involves defining a noise field, and the associated noise correlation matrix (denoted $R_{nn}$) at the sensors. A set of noise sources is defined and the response to each of them at each sensor is also calculated. According to the prior art this is usually a spherical noise diffuse field (e.g. a cylindrical diffuse field is quoted by Bitzer and Simmer in [18]). In this case the noise field consists of a set of un-correlated plane waves. By way of contrast, according to the present invention any variation of noise field may be used, from a diffuse field to one that only originates in a particular sector.

Depending on the size of the array relative to the acoustic wavelength and the number of microphones, the noise cross-correlation matrix ($R_{nn}$) can be ill conditioned at the low frequency end. In this case, the prior art proposes making the matrix invertible by a known regularisation technique, generally by adding a small positive number $\sigma^2$ on the diagonal. Physically, this is the equivalent of adding a white noise field or a quadratic constraint controlling the amplitude of the beamforming optimal weight $w_{opt}$ to the optimisation problem. By increasing $\sigma^2$ the main lobe beamwidth can be widened. The noise cross-correlation matrix is normalised so that in the limit, as $\sigma^2$ tends to infinity, $R_{nn}$ tends to I (i.e. the classical delay and sum method).

According to prior art methods; the next step defines a vector in the look direction at angle θ of interest ($d_\theta$). As the method presented herein relates to fixed beamforming, sectors are defined all around the array for detection of potential sources. The beamforming algorithm has fixed weights for each of these sectors and is coupled with a beamsteering algorithm tracking the sector where the source is positioned. According to the present invention, for each sector, with the look direction θ, a set of vectors is defined as follows:

- pairs of vectors whose directions are symmetric relative to direction θ
- pairs of vectors whose directions are asymmetric relative to direction θ,
- single vectors with directions different from θ

All of these vectors contain the sensor signals induced by an acoustic source positioned in predetermined directions at a given elevation and distance from the array. They are used to correct the beampattern asymmetry resulting from the array and obstacle geometry. While the superdirective approach requires defining a look direction θ for each sector, one modification according to the present invention uses a slightly different angle $\theta+\epsilon$($\epsilon$ is a small real number) to steer the beam in the direction of interest and thereby compensate for the effect of the array (loss of look direction).

A set of linear or quadratic constraints built with the set of vectors defined in each sector, is then introduced in the optimisation process to obtain the optimal weighting vector $w_{opt}$ for correction of the beamwidth and beampattern asymmetry. The number of linearly independent constraints imposed can be as many as there are sensors.

The method provides a solution to implement a fixed beamformer with a microphone array embedded in a complex obstacle, such as a telephone set for example. The correction of the beampatterns and the loss of look direction are important for the best efficiency possible in terms of noise filtering and source enhancing. Correction of the look direction is important if the beamsteering algorithm is based upon the beamforming weighting coefficients, which is the case here. It allows a more accurate detection.

BRIEF DESCRIPTION OF THE DRAWINGS

Embodiments of the present invention will now be described more fully with reference to the accompanying drawings, in which.

DETAILED DESCRIPTION OF THE PREFERRED EMBODIMENTS

The following table contains the different notations used in this specification, from which it will be noted that the frequency dependency for matrices, vectors and scalars, has for the most part been omitted to simplify the notations. Any other specific notations not appearing in Table 1 are defined in the specification.

TABLE I

| Notations<br>NOTATIONS | |
|---|---|
| d | complex vector (column vector) |
| $d_i$ | complex vector $i^{th}$ component |
| $d_i^*$ | complex conjugate of the vector $i^{th}$ component |
| $d^H$ | d Hermitian transpose (line vector) |
| $d_N$ | complex vector (column vector) index N |
| $d_\theta$ | complex vector (column vector) index θ |
| R | Complex Matrix |
| $R^H$ | Complex Hermitian transpose Matrix |
| I | Identity matrix |
| $W^H d$ | Hermitian product |
| ω | Circular frequency (=2 πf f: frequency in Hz) |

Figure 1:
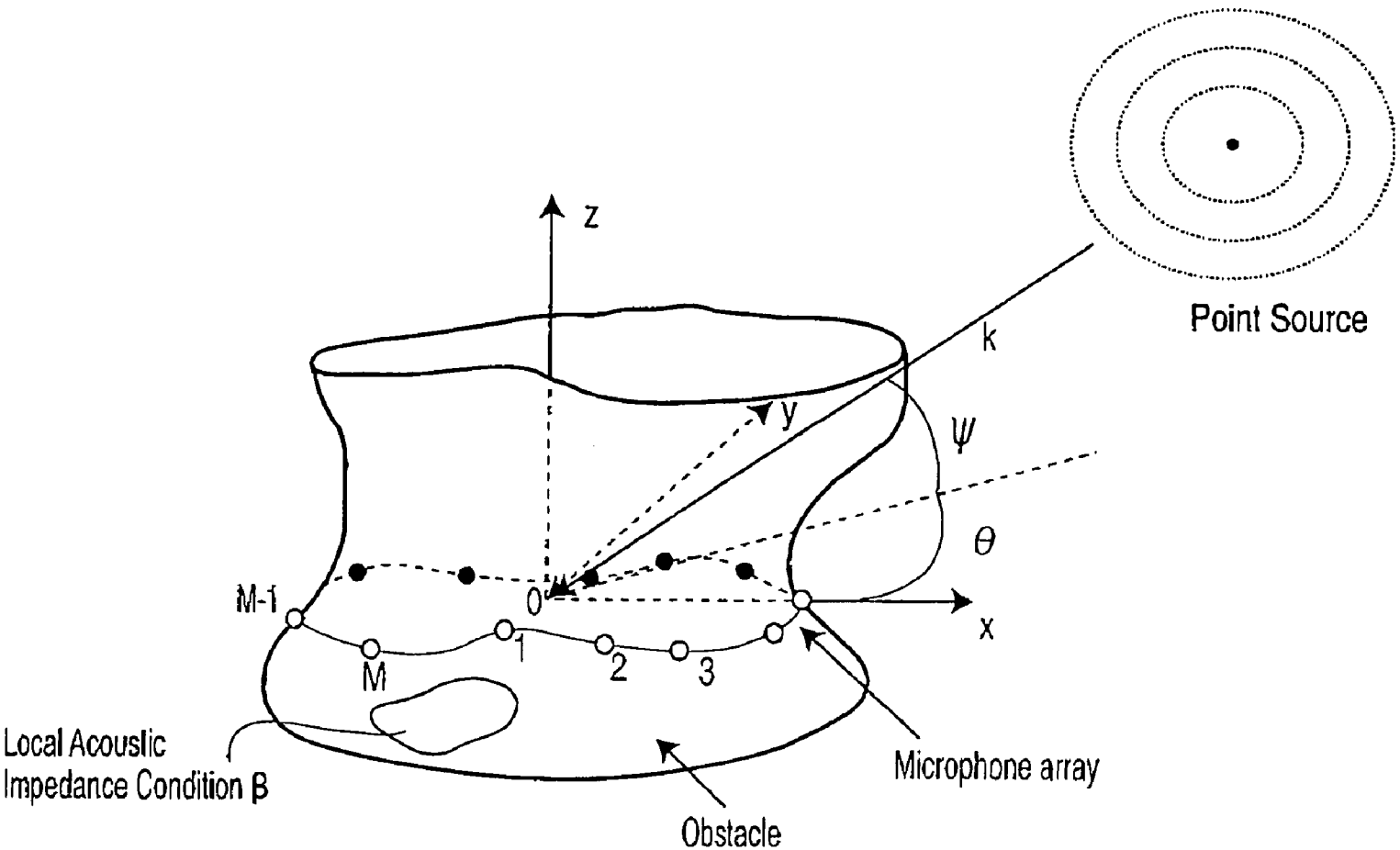
FIG. 1 is a schematic illustration of an obstacle having an asymmetrical shape, a microphone array thereon, and a point source of sound in the near field of the far field.

FIG. 1 shows an obstacle, which may or may not contain local acoustical treatment on the surface thereof and a sensor array of M microphones on the surface. A point source of sound is located in the k direction at an angle θ in the x-y plane and an angle ψ in the z plane. For simplification purposes the array is in a plane but the way the beam pattern is "constrained" is very general and can be applied to arrays with 3D geometry.

The impedance condition (i.e. local surface treatment), the distance between sensors (or microphones) and the shape of the obstacle are all variable.

Let $d_{\rho,\theta,\psi}(\omega)$ be the signal vector at the M sensors for a source at position (ρ,θ,ψ) in spherical co-ordinates. Although a point source is assumed in the near field, the method of the present invention can be extended to far-field sources, typically plane waves (wave vector k). Let n be a noise vector due to the environment, where n is not correlated to the signal d, and where n and d are both dependant upon the frequency ω. Let $R_{nn}(\omega)$ be the normalised noise correlation matrix, depending on the nature of the noise field. For an omni-directional noise field (spherical), cylindrical or any other "exotic" field adapted to a specific situation, $R_{nn}(\omega)$ can be calculated using a set of non correlated incident plane waves around the sensor array.

Designing a beamformer consists of finding a weighting vector $w_{opt}$ (complex containing amplitude and phase information), such as the Hermitian product $w_{opt}{}^H d$, for enhancing the signal of the source in the desired direction (i.e. look direction) while attenuating the noise contribution. According to the superdirective method, this is done by minimising the noise power while looking in the direction of the source, or equivalently, maximising the Signal to Noise ratio under a linear constraint.

Design of the Beamformer

A fixed beamforming algorithm is set forth below, although the inventive method may be extended to adaptive beamforming under constraint (e.g. such as in Frost [9]).

The diffuse noise field (3D cylindrical or spherical) is assumed to be modelled by a set of L non-correlated plane waves resulting in L noise vectors $n_N$, N={1, . . . , L}. It is assumed that the vector of look direction d or $d_\theta$ is not correlated with the vectors of non-look direction $n_N$.

The noise vectors can be computed analytically for a free-field sensor array, a sensor array embedded in a sphere or an infinite cylinder. Since the determination of n requires computation of the noise acoustic pressure at the M sensors, if a sensor array is embedded in any other shape of obstacle, Infinite Element (IFEM) or Boundary Element (BEM) methods must be used.

As an illustration of the applications set forth herein, the noise field is a set of non-correlated plane waves emanating from all directions and $R_{nn}$ defined in the following way:

$$R_{nn}(\omega) = \frac{1}{L}\sum_{N=1}^{L} n_N \cdot n_N^H \tag{1}$$

In the low frequency end, the matrix $R_{nn}$ is generally ill conditioned due to size of the array relative to the acoustic wavelength. For an inversion, $R_{nn}$ must be regularised taking into account the fluctuations of each microphone (white noise). Some authors have introduced amplitude and phase variations to account for microphone errors (e.g. Ryan [4]). The regularisation is equivalent to a quadratic constraint on the weighting vector w amplitude that can tend to infinity when the matrix is ill conditioned. $R_{nn}$ can be regularised as:

$$R_{nn}=R_{nn}+\sigma^2 I \tag{2}$$

where $\sigma^2$ is a small number. This regularisation is made at the expense of the directivity.

The signal vector d(ω) contains the signal induced by the acoustic source to be detected, at the M sensors at frequency ω. It depends on the nature of the source (i.e. far field acoustic plane wave, near field, acoustic monopole, or any other type that can be modelled by numerical simulation).

Figure 2:
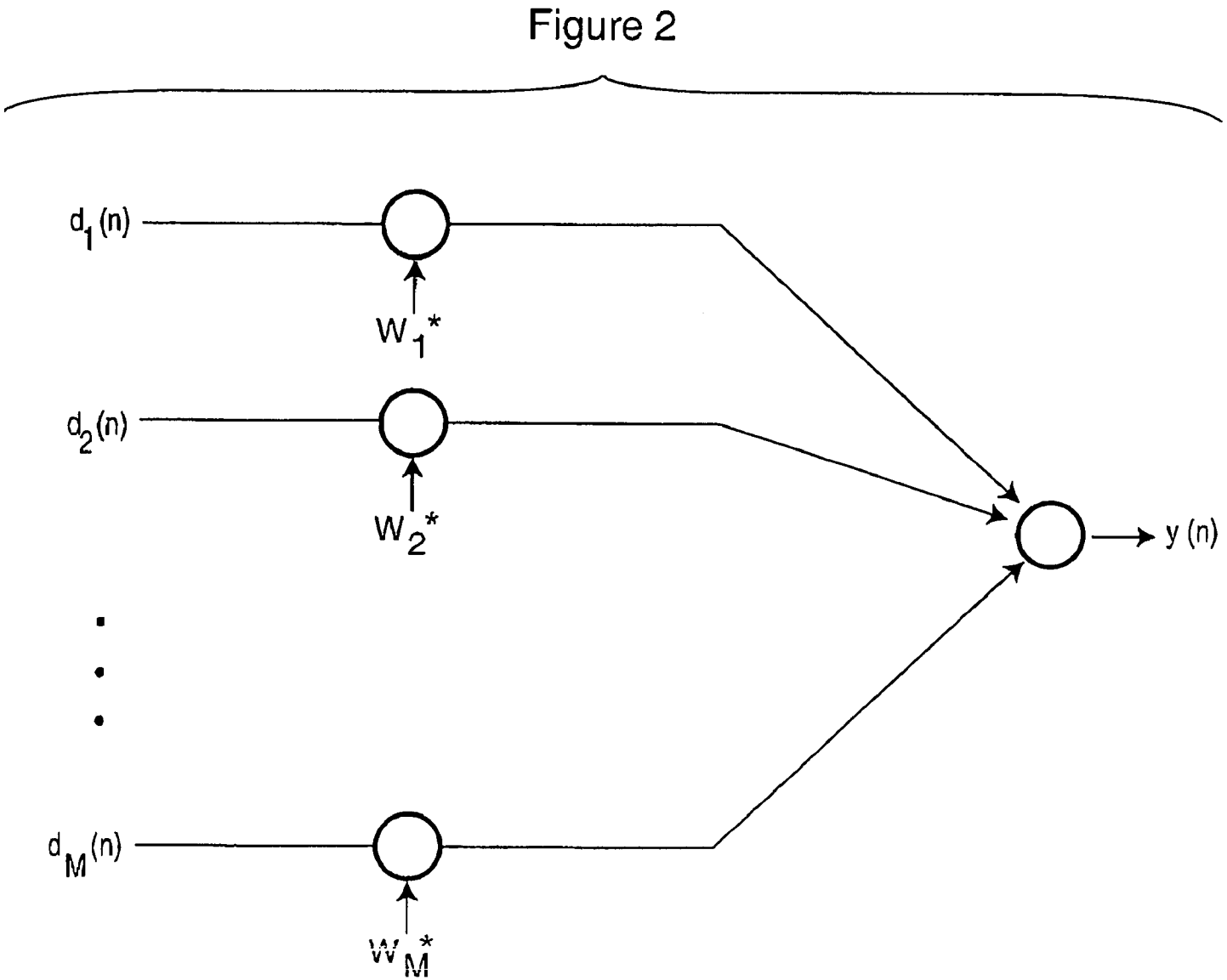
FIG. 2 is a block diagram of a classical beamformer, according to the prior art.

Designing the beamformer requires finding a set of optimal coefficients, $w_i$ at each frequency ω such that weighting the signal $d_i$ at each microphone "orients" the beam towards the source. FIG. 2 is a block diagram of a classical beamformer where weights $w_1^*$ . . . $w_M^*$ are applied to the M microphone signals $d_1(n)$ . . . $d_M(n)$ before being summed into y(n).

According to the superdirective approach, the weighting vector w is the solution of the following optimisation problem:

$$\mathrm{Min}_w \frac{1}{2} w^H R_{nn} w \text{ subject to } w^H d = 1 \tag{3}$$

where the explicit dependence on the frequency ω for each vector and matrix is omitted to simplify the notation. In short, the superdirective approach minimises the noise energy while looking in the direction of the source. Minimising the following functional $$J(w, \lambda) = \frac{1}{2} w^H R_{nn} w + \lambda(1 - w^H d) \quad (4)$$

gives the optimal weight vector $w_{opt}(\omega)$.

This functional is quadratic since the matrix $R_{nn}$ is Hermitian and positive (defined due to its link to signal energies). A pure diagonal $R_{nn}$ (=I) makes the superdirective method equivalent to the classical Delay & Sum method (white noise gain array).

Under this condition, a null of gradient of J is a necessary and sufficient condition to generate a unique minimum.

Differentiating J following w, yields:

$$\frac{\partial J(w, \lambda)}{\partial w} = R_{nn} w - \lambda d = 0 \quad (5)$$

and the optimal weight vector is:

$$w_{opt} = \lambda R_{nn}^{-1} d \quad (6)$$

The Lagrange coefficient λ realising the constraint in equation (3) is such that:

$$w_{opt}^H d = 1 \text{ i.e. } \lambda d^H R_{nn}^{-H} d = 1 \quad (7)$$

as $R_{nn}$ is a Hermitian matrix, $R_{nn}^{-1}$ is an Hermitian matrix and $R_{nn}^{-H} = R_{nn}^{-1}$. Thus $$\lambda_{opt} = \frac{1}{d^H R_{nn}^{-1} d} \quad (8)$$

and the solution is:

$$w_{opt} = \frac{R_{nn}^{-1} d}{d^H R_{nn}^{-1} d} \quad (9)$$

The directivity is highly dependent on frequency for simple geometries such as circular arrays or linear arrays in free field or in simple solid geometry such as a sphere.

Figure 3:
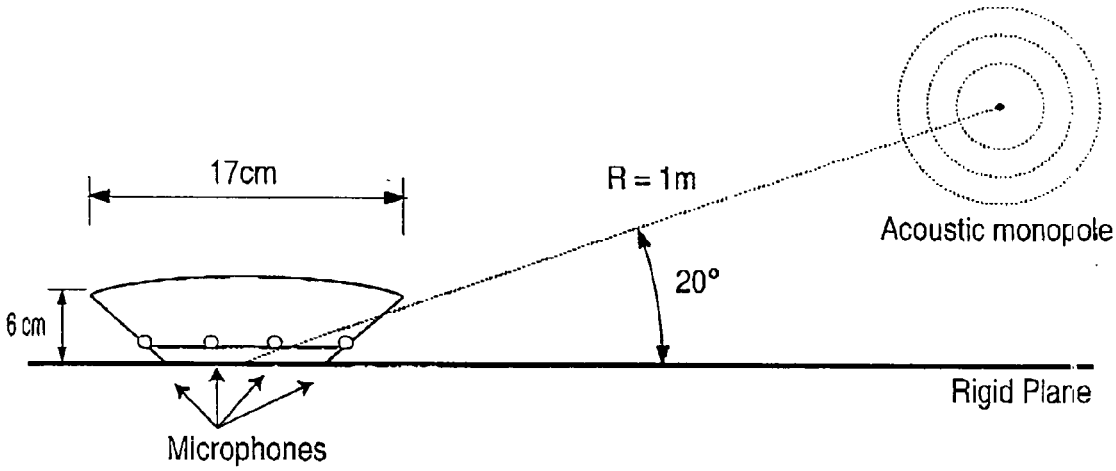
FIG. 3 is a side view, schematic of a symmetrical microphone array embedded in an axi-symmetric truncated cone obstacle, according to the prior art.
Figure 4:
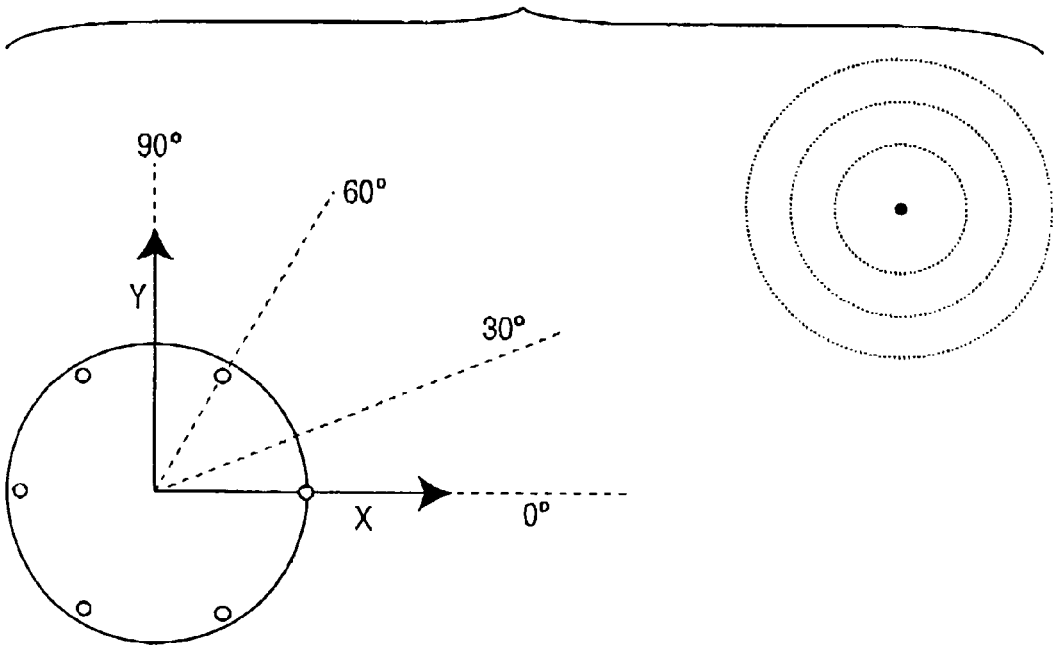
FIG. 4 is a view from the top of the symmetrical (round) array of FIG. 3.
Figure 5:
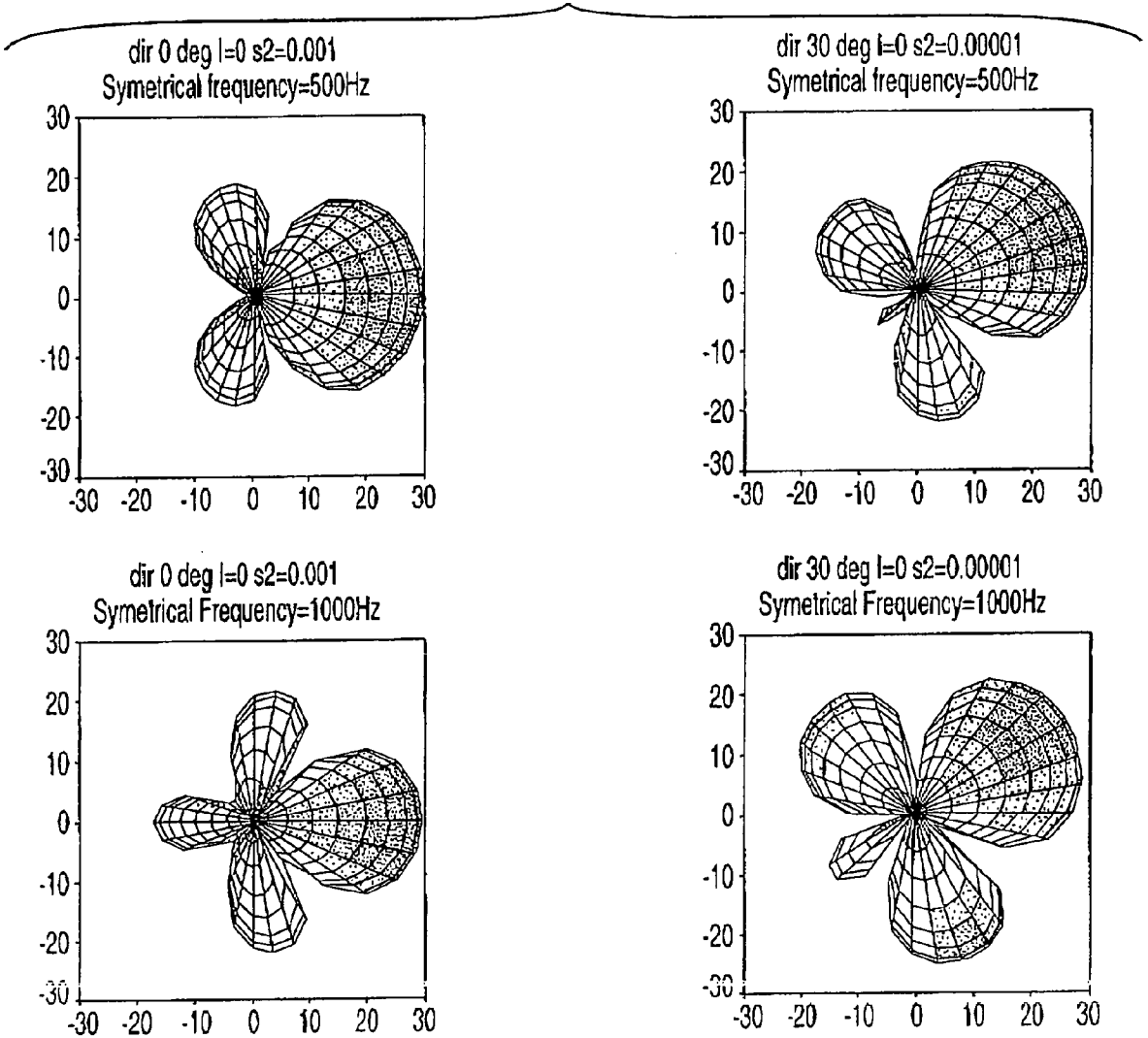
FIG. 5 illustrates variation of a microphone array beamwidth for a beam at 0° and 30° at frequencies of 500, 1000 and 2000 Hz for superdirective beamforming, according to the prior art.
Figure 5:
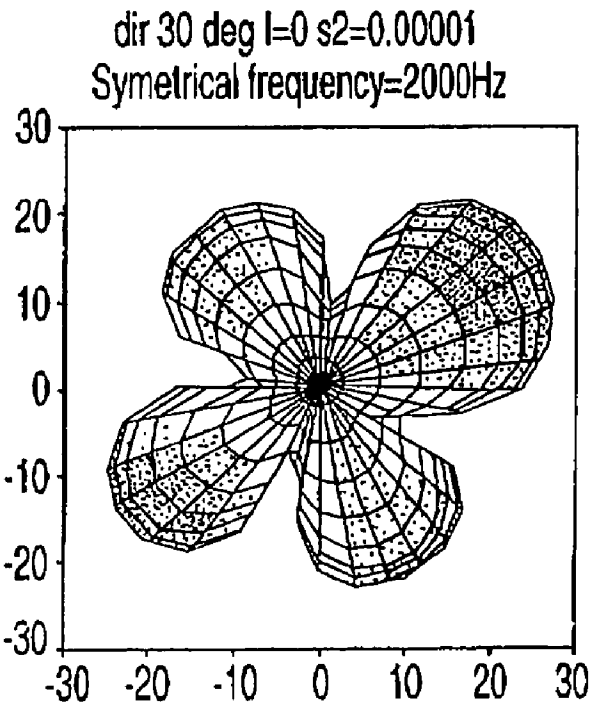
Figure 5:
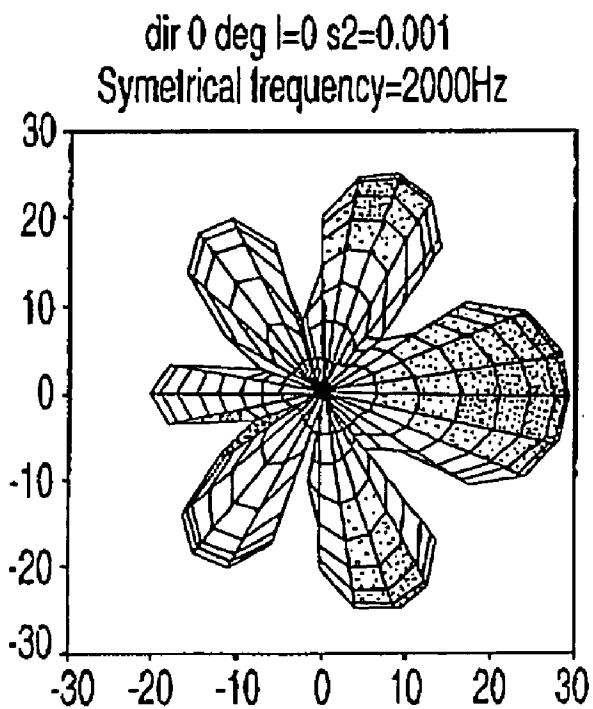

An application of the beamforming technique set forth above to a circular microphone array over a plane is shown with reference to FIGS. 3, 4 and 5.

FIG. 3 is a side view schematic of a symmetrical microphone array embedded in an axi-symmetric truncated cone obstacle having bottom diameter of 10 cm, top diameter 16 cm, and a height of 6 cm. The acoustic monopole is at an elevation of ψ=20° and at a distance ρ=1 m. As shown in FIG. 4, the source can be rotated about the array.

For the array of FIGS. 3 and 4, the weight vector is computed for twelve 30° sectors around the array, wherein six of the sectors contain a microphone. The beamformer is used in conjunction with a beam steering algorithm. Due to axisymmetry, only two different weight vectors are required. One of the advantages of such an array is that an almost constant beamwidth is achieved when the source to be detected moves around the obstacle. As shown in FIG. 3, although the beamwidth is not constant vs. angle of arrival θ, the beam lobes are symmetrical and point towards the look direction. This is no longer the case, however, when the array is elliptic, or example, or when it is embedded in an obstacle whose geometry is not axi-symmetric.

Non Axi-symmetric Sensor Arrays

When the array is no longer circular, the beam varies with the azimuth angle of the source at each frequency. Consider the elliptical array illustrated in FIG. 6 where the minor axis a=2 cm, and the major axis b=7.5 cm, and where the microphones are in the plane z=0.01 m. The acoustic source to be detected is at a distance of 1 meter and an elevation of 20°. Beampatterns are computed for different source azimuth angles from 0 to 360 degrees. The elliptic array is considered herein for illustration purposes only. Other asymmetrical arrays may be used.

Figure 6:
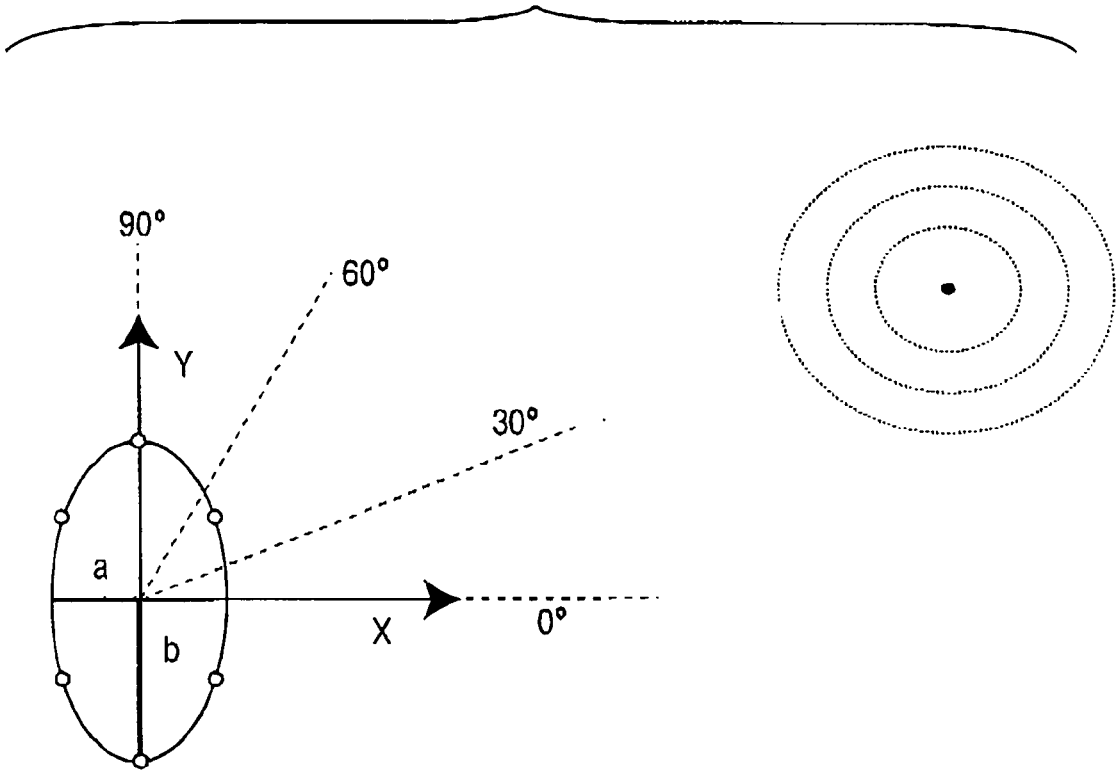
FIG. 6 is a view front the top of an asymmetrical (elliptical) array in free field for illustrating the principles of the present invention.
Figure 7:
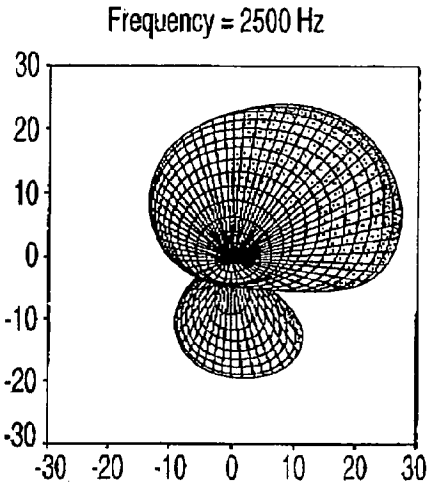
FIG. 7 illustrates free-field elliptical array beampattern variation vs. signal angle of arrival for 0°, 30°, 60° and 90° using both the superdirective and the delay and sum approach.
Figure 7:
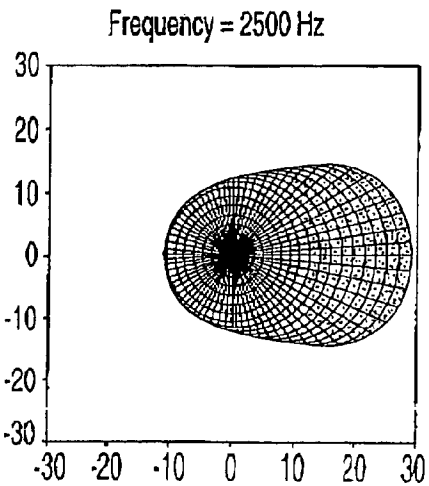
Figure 7:
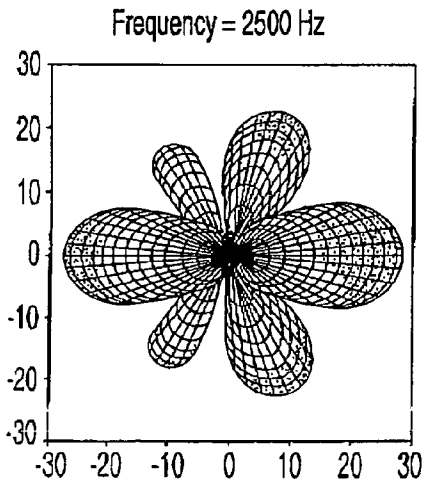
Figure 7:
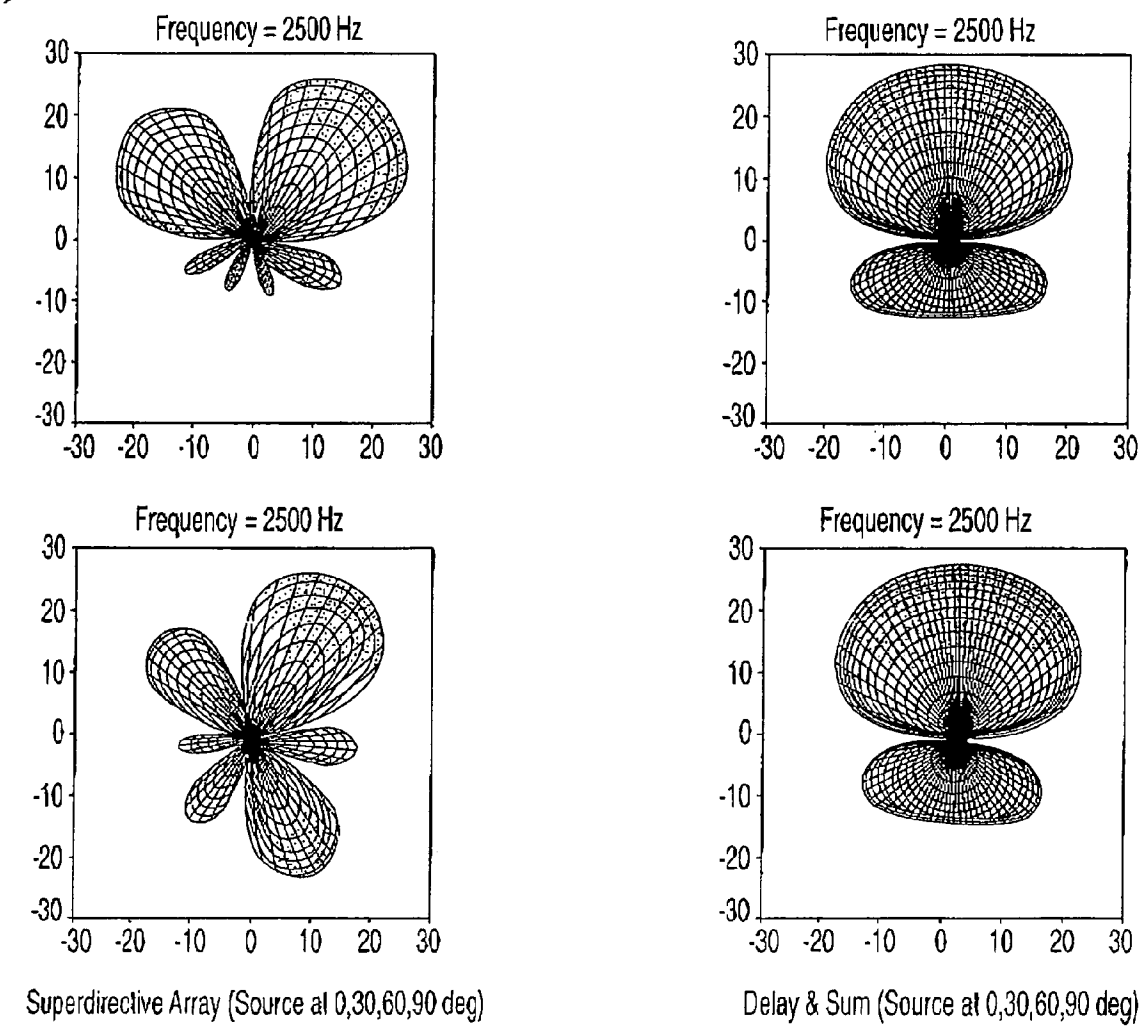

FIG. 7 shows the beam patterns for the elliptic array of FIG. 6 in free field over a rigid plane, in a delay and sum scheme and for a pure super-directive approach. It will be noted when comparing the beampatterns generated by these two techniques that the beamwidth varies significantly (especially when comparing 0 and 90 degrees). The super-directive method provides a narrower beam but suffers from a front-back ambiguity at 0 degrees. There is symmetry at 0 and 90 degrees as the away is symmetrical from those angles. The beams at 30 and 60 degrees are very asymmetrical, including the side lobes and the main lobes appear to point in the wrong direction at some frequencies in both cases.

When the sensor array is embedded in an obstacle, the results can be worse, due to diffraction of acoustics waves and the geometry of the obstacle rendering the implementation of beamforming and beamsteering critical. It is an object of the present invention to provide a method that overcomes these problems.

DETAILS OF THE INVENTION

Since the fixed beamformer has frozen coefficients $w_{opt}$, their determination is predictive by nature and any method of determination may be used, provided that the vector $w_{opt}$ has the best possible components for a given signal angle of arrival Θ. To correct the beamwidth and even the symmetry of the main lobe pattern, the minimisation of eq.(3) is realised under constraint. Let $d_{(\rho,\Theta,\psi)}$ be the sensor signal vector for a source at position (ρ,Θ,ψ), and d the signal vector of the source to be detected.

$$w_{opt}^H d = 1 \quad (10)$$

The Hermitian product $w_{opt}^H d_{\rho,\Theta,\psi}$ describes the 3D beampattern of the microphone array for a source moving in 3D space at a radius ρ from the centre of the array and $0 \leqq \Theta < 2\pi$, $$-\frac{\pi}{2} \leq \psi \leq \frac{\pi}{2}.$$

For the example of FIG. 6, where ρ=1 m and Ψ=20 degrees corresponds to the elevation of a talker for a telephone conference unit on a table, then $d_{(1,\Theta,20)} = d_\Theta$.

Correction of the Beam Pattern

Now let $d_\theta = d$ be the sensor signal vector at the M microphones for a look direction θ.

In order to modify the beampattern the following vectors are introduced: $d_{\Theta+\theta_i}$ and $d_{\Theta-\theta_i}$ where the angles $\theta_i > 0$, with $i = \{1, \ldots N_\theta\}$ constitute a set of direct generally belonging to the main lobe beam directivity angle.

The choice of the angles $\theta_1$ and their number depends on the beamwidth or the main lobe beampattern asymmetry after unconstrained minimisation, and the required beamwidth or lobe symmetry.

Firstly, it will be noted that for M microphones, a set of M linearly independent constraints can be considered. Secondly, the constrained minimisation process for shaping the beam gives a sub-optimal solution $w_{opt}$ generally at the expense of increased amplitude in the secondary lobes or an increase in beam width.

Beamwidth Correction for a Symmetric Beampattern

The problem of finding the optimal weighting vector $w_{opt}$ for a look direction $\theta$ becomes:

$$\mathrm{Min}_w \frac{1}{2} w^H R_{nn} w \text{ subject to } w^H d = 1 \tag{11}$$

and subject to additional constraints using a pair of symmetric vectors $d_{\theta+\theta_i}$ and $d_{\theta-\theta_i}$. These constraints are either: (i) a set of 2i ($i=\{1,2, \ldots N_{const}\}$) linear constraints $$w^H d_{\theta+\theta_i}=\alpha_i \tag{12}$$

$$w^H d_{\theta-\theta_1}=\alpha_1 \tag{13}$$

In this case the equation (11) under constraint can be written:

$$\mathrm{Min}_w \frac{1}{2} w^H R_{nn} w \text{ subject to } C^H w = g \tag{14}$$

where C is a rectangular matrix defined by:

$$C=[d|d_{\theta+\theta_1}|d_{\theta-\theta_i}| \ldots] \tag{15}$$

and g is a vector defined by:

$$g = \begin{bmatrix} 1 \\ \alpha_i \\ \alpha_{-i} \\ \vdots \end{bmatrix} \tag{16}$$

The constraint in (14) synthesises the constraints defined in (11), (12) and (13).

The optimal weight vector $w_{opt}$ under these conditions is given by:

$$w_{opt}=R_{nn}^{-1}C[C^H R_{nn} C]^{-1} g \tag{17}$$

(ii) or a set of quadratic constraints. In this case $d_{\theta+\theta_1}$ and $d_{\theta-\theta_1}$ are used to build the cross-correlation matrix:

$$D_{\theta_1}=d_{\theta+\theta_i} d_{\theta+\theta_i}^H+d_{\theta-\theta_1} d_{\theta-\theta_i}^H \tag{13}$$

and the quadratic constraints are defined in the following way:

$$w^H D_{\theta_1} w=\beta_i \tag{19}$$

where $\beta_i$ is a set of values required for $w^H D_{\theta_i} w$. The optimal weight vector $w_{opt}$ then minimises the following objective function.

$$J(w, \lambda, \lambda_2) = \frac{1}{2} w^H R_{nn} w + \lambda(1 - w^H d) + \sum_i \lambda_i(\beta_i - w^H D_{\theta_i} w) + \sigma^2(\gamma - w^H w) \tag{20}$$

where the Lagrange coefficients $\lambda$, $\lambda_i$ are dependant on frequency $\omega$.

Figure 8:
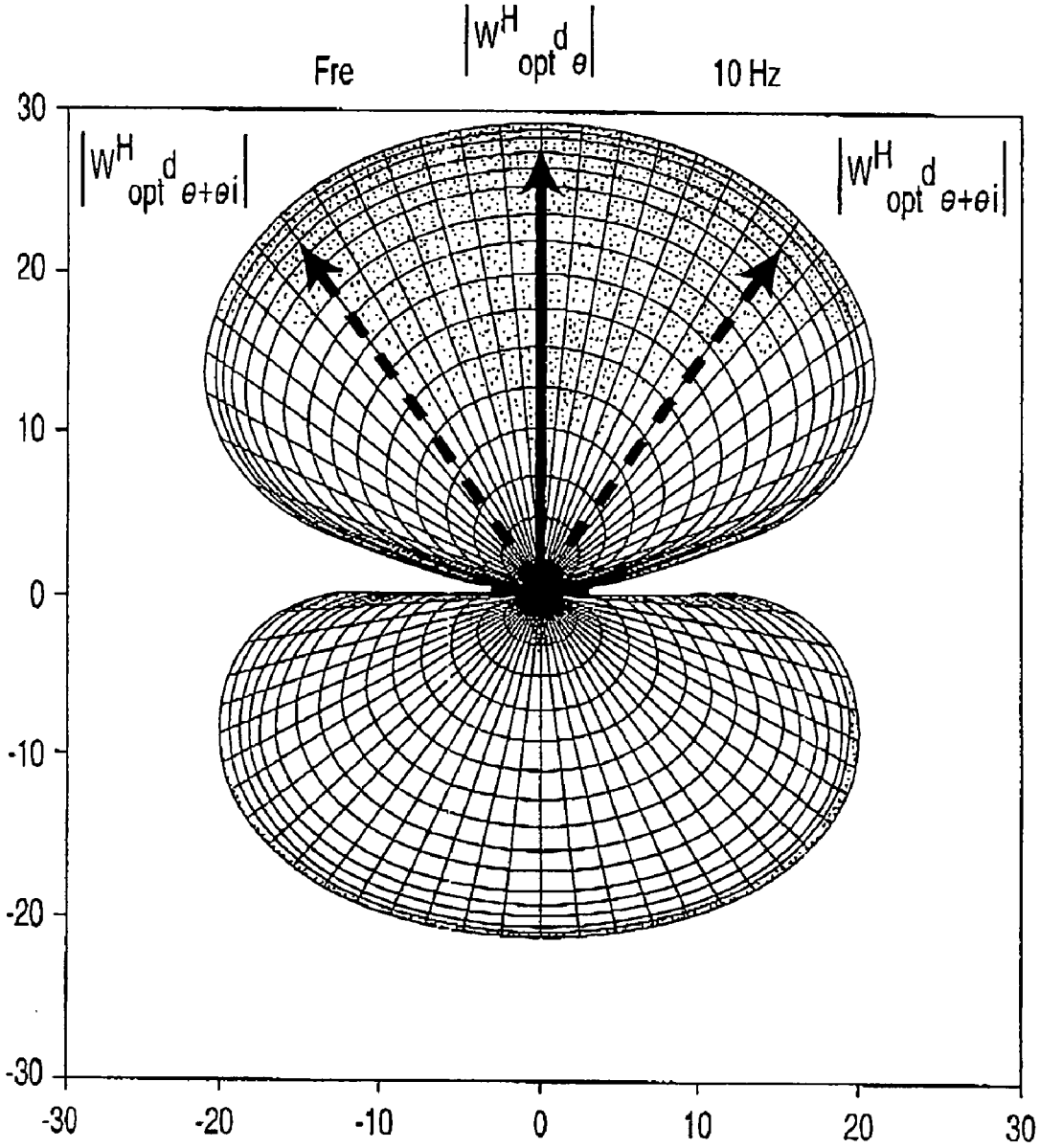
FIG. 8 shows an example of a pair of "symmetric vectors" (symmetry relative to the look direction) taken into consideration in the optimisation process for the case of a symmetrical main lobe, to modify the beamwidth.

FIG. 8 shows an example of choice of vectors according to the optimisation process described above, where constraints are added in the functional J to provide the correction. In this case the main lobe is symmetrical.

As discussed above, it is known from the prior art to correct beampattern main lobe beamwidth with a set of "symmetric" vectors [6].

Asymmetry and Beamwidth Correction for a Non Symmetric Beampattern

Since the look direction $\theta$ generates a non-symmetric beam after minimisation of the unconstrained superdirective method functional $J(w,\lambda)$, then the method of the present invention can be applied to modify its beamwidth and correct its asymmetrical aspect. This last operation is particularly useful since very often the beam does not point towards the required look direction even if the maximum $w^H_{opt} d_\theta=1$ is reached for the correct look direction $\theta$. The strong asymmetric array makes the beam globally "look" in a different direction. This deviation from the look direction depends on the frequency, the geometry of the array and the look direction angle.

According to one aspect of the present invention, this asymmetry is corrected by choosing a convenient set of vectors $d_{\theta\pm\theta_j}$. Additionally, a vector may be chosen to steer to an angle slightly different from the desired look direction.

In this situation, at least one pair of symmetrical vectors is chosen to adjust the beam width:

$$w^H d_{\theta+\theta_i}=\alpha_i \tag{21}$$

$$w^H d_{\theta-\theta_1}=\alpha_1 \tag{21bis}$$

with either at least a single vector $d_{\theta+\theta_i}$ (see constraint (22) below), or at least a pair of asymmetrical vectors $d_{\theta+\theta_i}$ and $d\theta-\theta_j$ (with $\theta_j \neq \theta_i$) chosen to correct the asymmetry (see constraint (23) below) and to "orient" the beam towards the correct direction. The set of linear constraints (23) is defined so that no information is needed on the value of the gains $w^H d_{\theta\pm\theta_i}$:

$$w^H d_{\theta\pm\theta_1}=\alpha_i \tag{22}$$

$$w^H(d_{\theta+\theta_j}-d_{\theta-\theta_i})=0 \text{ with } \theta_j \neq \theta_1 \tag{23}$$

These constraints are defined broadband.

Figure 9:
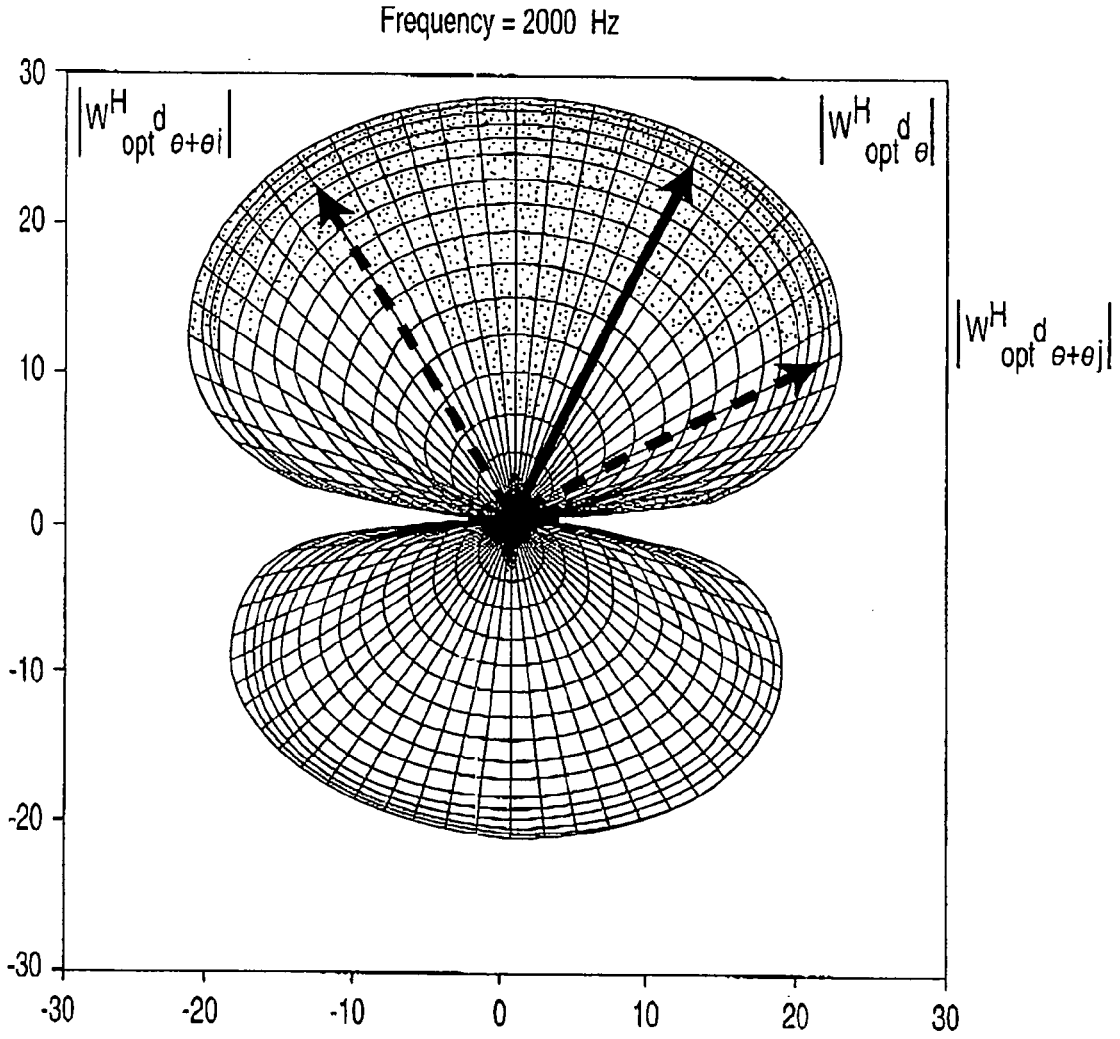
FIG. 9 shows an example of a pair of asymmetric vectors (relative to the look direction) taken into consideration in the optimisation process for correcting an asymmetrical main lobe according to the optimisation method of the present invention.

FIG. 9 shows an example of a pair of "asymmetrical" vectors according to the optimisation process described above, where constraints are added in the functional J to provide the asymmetry correction. In this case the main lobe is asymmetrical and the desired look direction is 60°.

Figure 10:
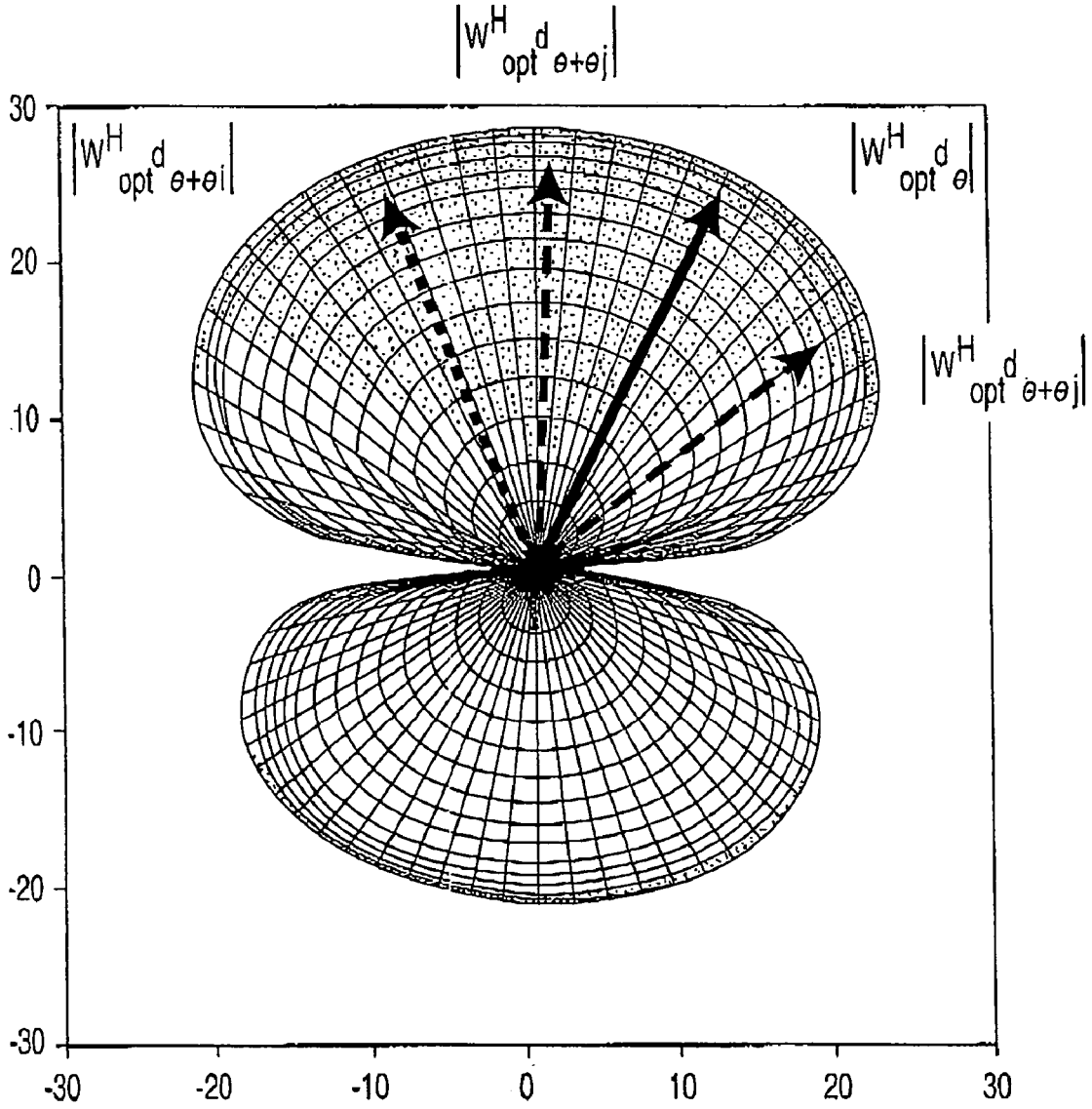
FIG. 10 shows an example of a pair of symmetrical vectors (relative to the look direction) for correcting the beamwidth and a single vector for correcting an asymmetrical main lobe, according to the optimisation method of the present invention.

FIG. 10 shows a pair of symmetrical vectors to correct the beamwidth and a single vector to correct the asymmetry.

A quadratic set of constraints can also be applied. The cross-correlation matrices associated with these vector choices are:

$$D_{\theta_j}=d_{\theta\pm\theta_j}d_{\theta\pm j}^{H} \tag{24}$$

for the single vectors, $$D_{\theta_i}=d_{\theta+\theta_i}d_{\theta+\theta_i}^{H}+d_{\theta-\theta_j}d_{\theta-\theta_j}^{H} \tag{25}$$

for the pair of symmetric ($\theta_j=\theta_i$) or asymmetric ($\theta_j\neq\theta_i$) vectors. The optimisation process for determining $w_{opt}$, consists of minimising a cost function similar to (20).

This key aspect of the present invention allows, among other things, implementation of a non axi-symmetric microphone array in a non axi-symmetric shape, with reasonably symmetric beam shapes. The implementation consists of defining several sectors around the array, and sets of symmetric, asymmetric pairs of vectors or single vectors to correct the beamwidth and the beam lobe asymmetry. The inventive beamforming approach is coupled with a beamsteering algorithm that can be based on the optimal weighting coefficients computed for each sector, in a reduced frequency band.

Figure 11:
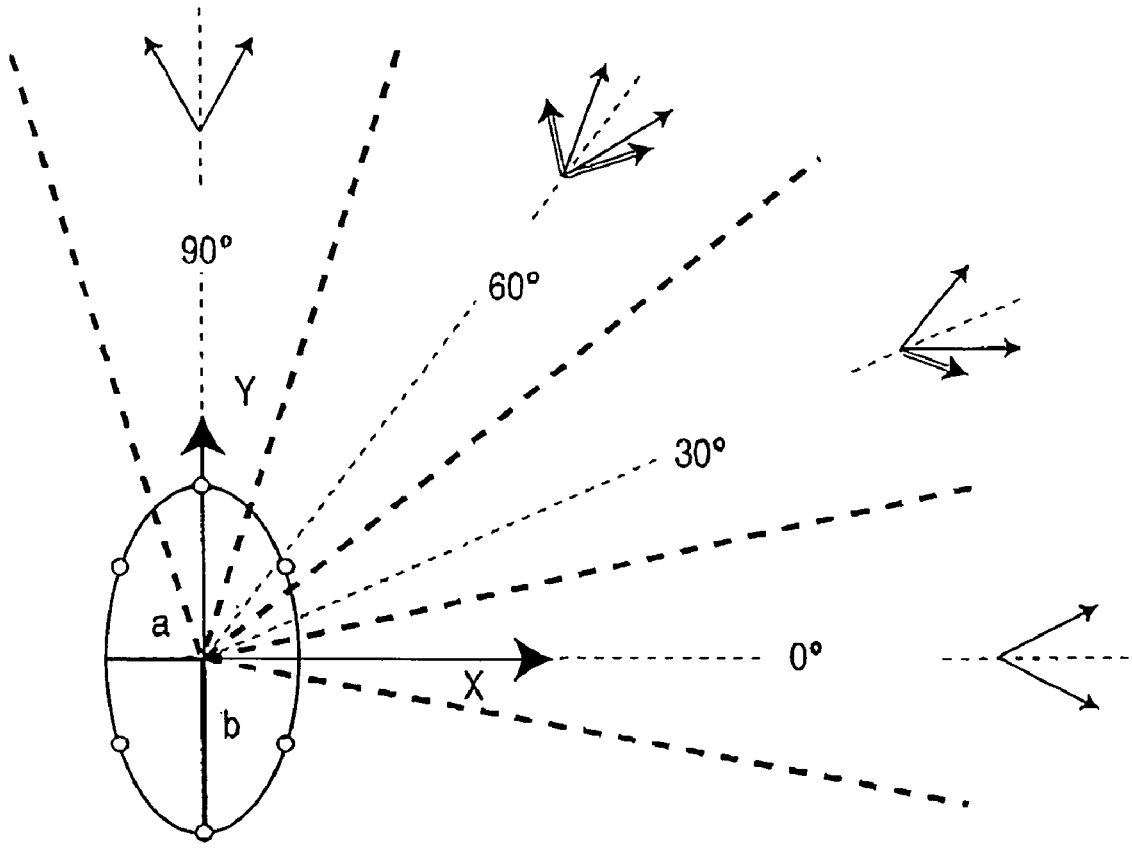
FIG. 11 illustrates fixed beamforming sectors with associated choices of correction vectors for an elliptic array.

An illustration of some of the fixed beamforming sectors with associated choice of correction vectors for an elliptic array is shown in FIG. 11.

Figure 12:
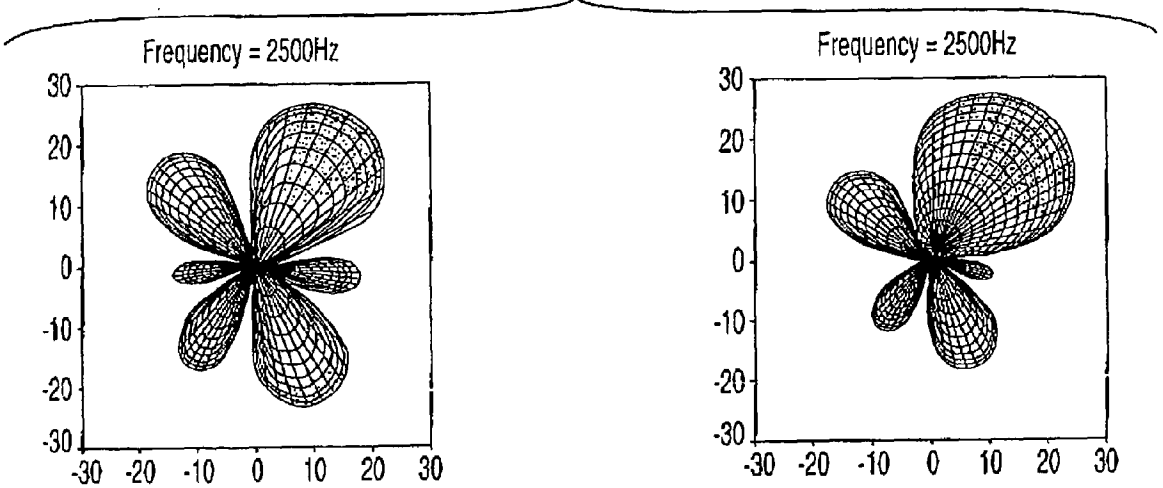
FIG. 12 shows correction of an asymmetrical beampattern (using a Superdirective approach, with a look direction=60°) and beamwidth correction.
Figure 13:
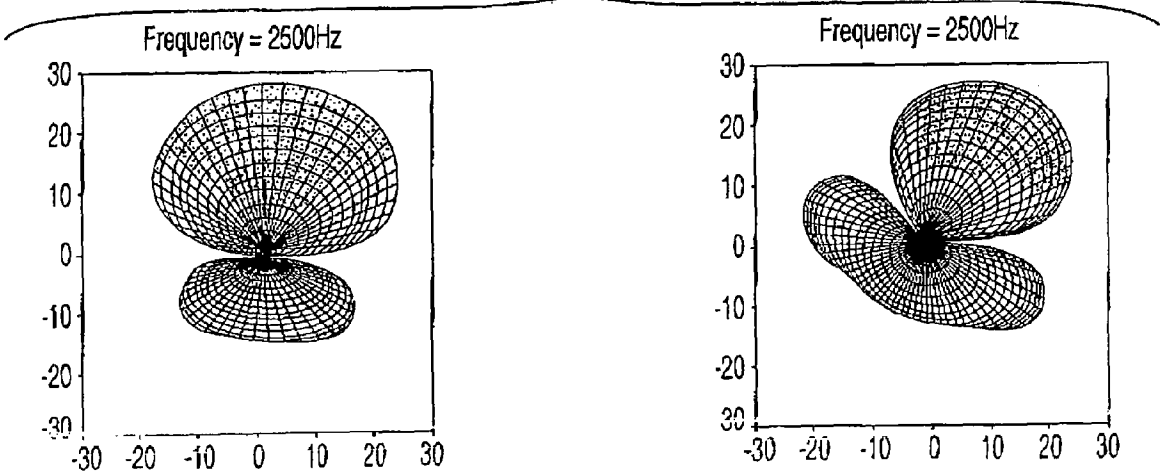
FIG. 13 shows correction of a poor directivity beampattern (using a Delay and Sum approach, with a look direction=60°)

FIG. 12 shows the correction of a beampattern in a super-directive approach for the elliptic array illustrated in FIG. 6. In this case, the beamwidth has been increased using one symmetric pair of vectors $d_{\theta+30}$,$d_{\theta-30}$ and the asymmetry has been corrected using $d_{\theta+}45$. The same vectors have been chosen in FIG. 13, to correct the poor directivity (delay and sum method), the strong asymmetry, and the undetermined look direction at 60 degrees. It will be noted that the correction shown in FIG. 13 is considerable.

Application: Optimal Beamforming of a Microphone Array Embedded in an Obstacle.

As discussed above, an important application of the present invention is in designing microphone arrays embedded in obstacles having "odd" shapes (non axi-symmetric) and dealing with induced problems such as: beampattern beamwidth variation vs. the look direction angle, loss of look direction, etc. The present method allows for the successful implementation of a microphone array in a telephone set for conferencing purposes or increased efficiency for speech recognition.

Figure 14:
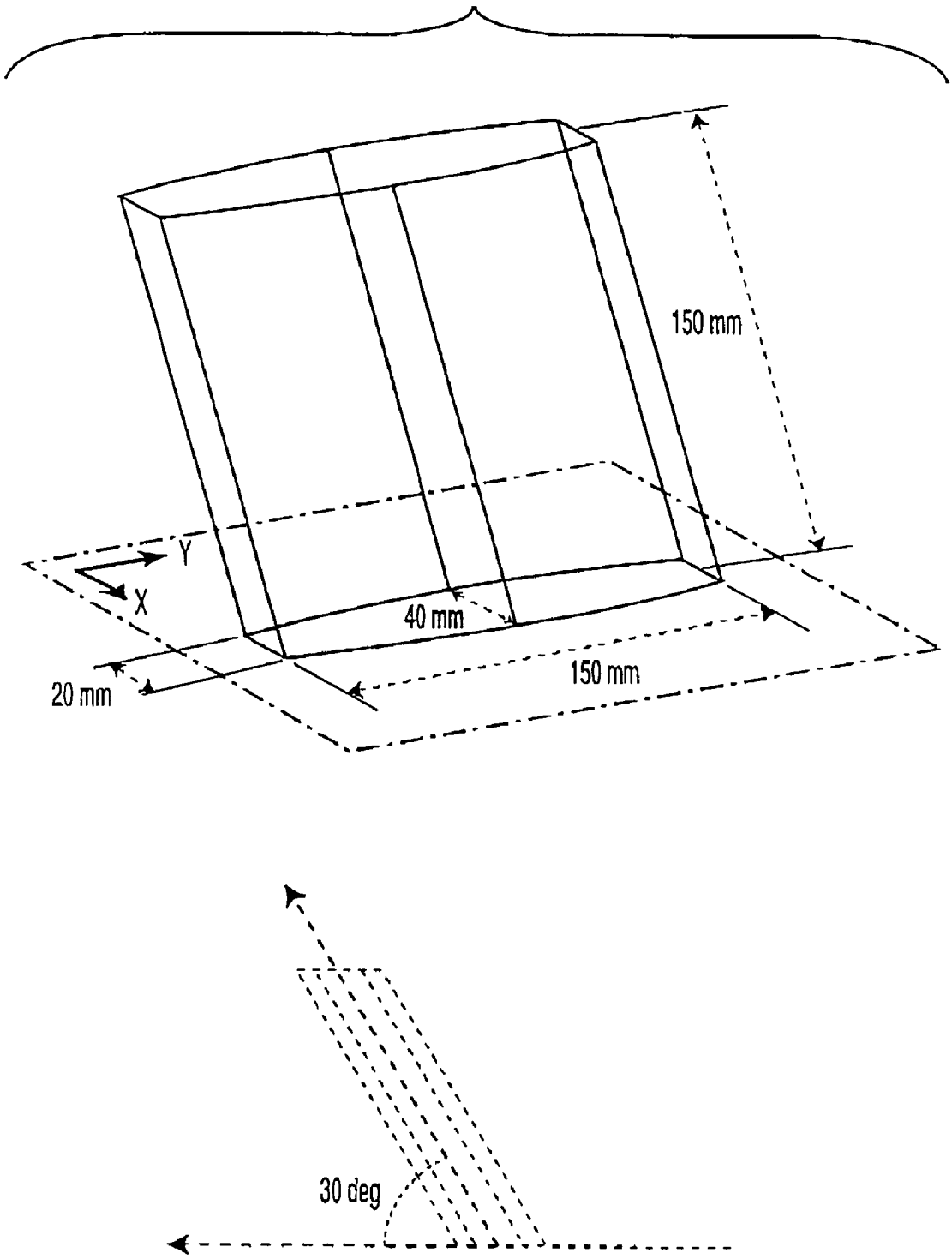
FIG. 14 is a mechanical definition of an obstacle used to illustrate the inventive method.

FIG. 14 shows a mechanical definition of an obstacle that mimics a telephone set, and is used herein to illustrate the application of the inventive method. Implementation of fixed beamforming requires the computation of optimal weights for different sectors. To accomplish this the pressure (magnitude and phase) from each source at each microphone must be determined. As no analytical expression is available for such a geometry, numerical methods are used to determine the required data.

Figure 15:
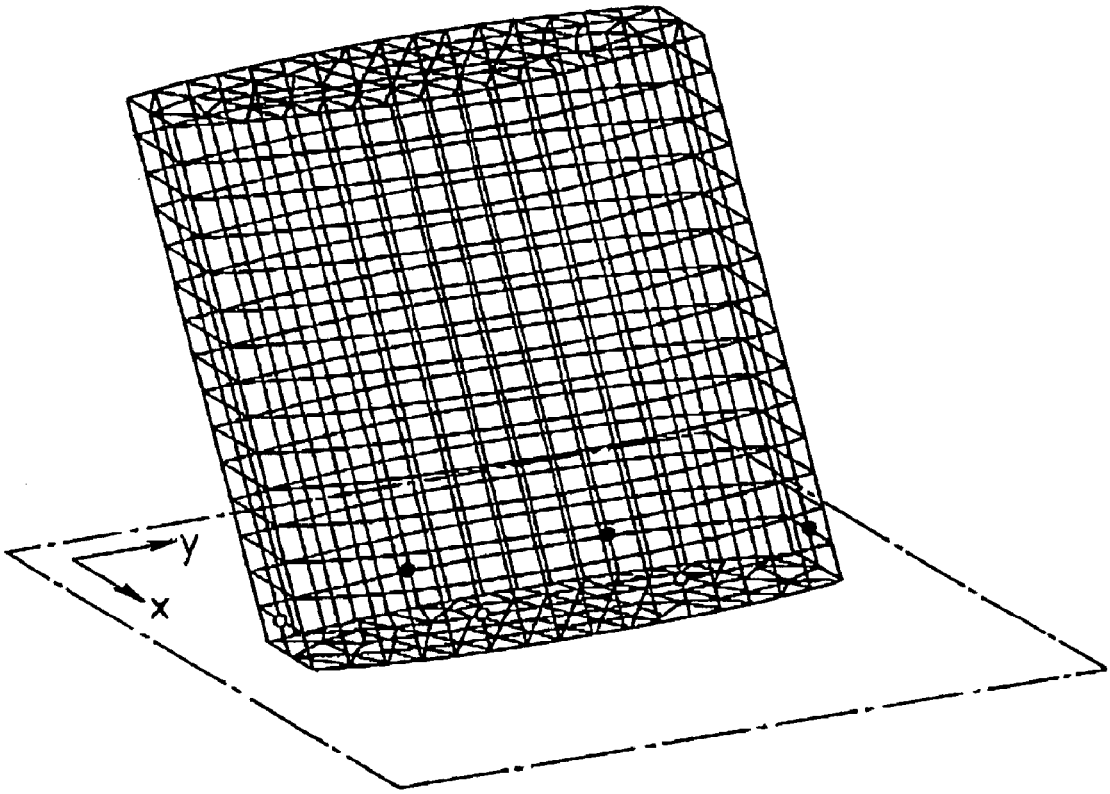
FIG. 15 Obstacle Boundary Element Model (using I-DEAS Vibro-acoustics) of the obstacle with six microphones positioned therein taking into consideration the; rigid plane supporting the obstacle.

FIG. 15 shows the Boundary Element model mesh (I-DEAS Vibro-acoustics) and the position of the six microphones, where the rigid reflecting plane supporting the obstacle is taken into consideration.

Figure 16:
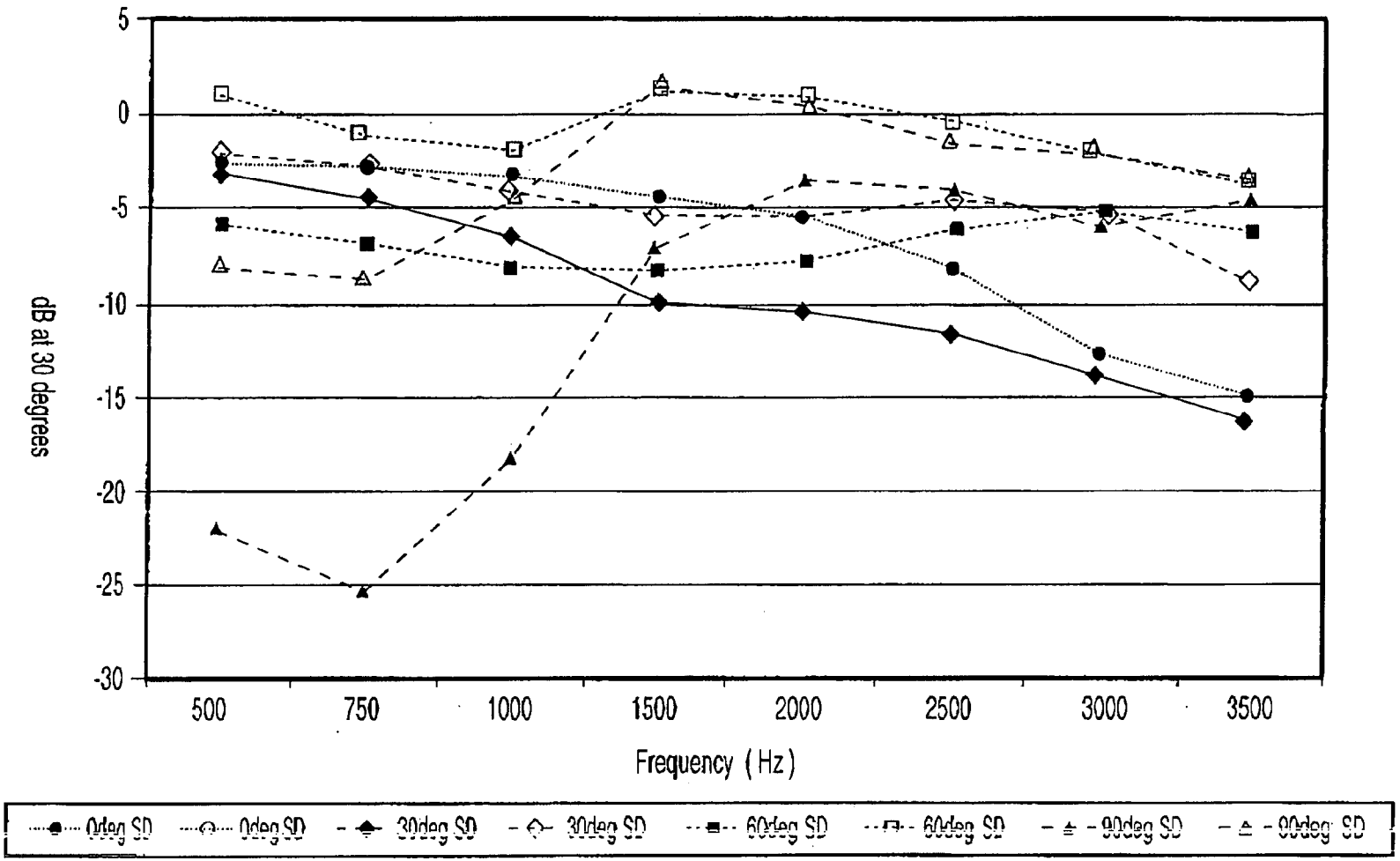
FIG. 16 shows beam pattern attenuation for the embedded elliptical array using the superdirective approach at +/−30° from the look directions 0°, 30°, 60° and 90° for various frequencies between 500 Hz and 3500 Hz.
Figure 18:
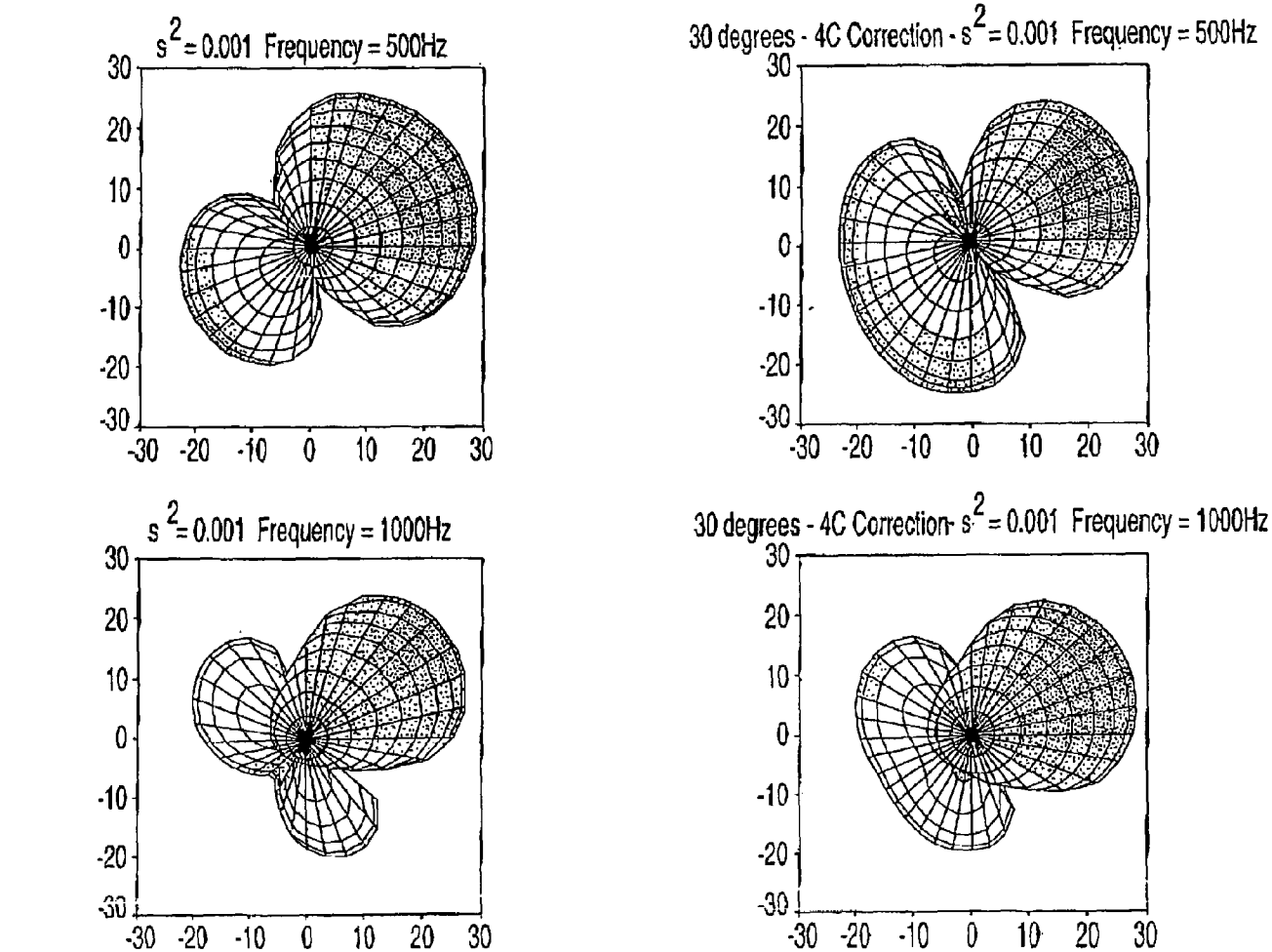
FIG. 18 illustrates beampattern variation vs. signal angle of arrival for the embedded elliptical array at 30° for 500, 1000, 2000 and 3000 Hz using the superdirective approach on the left hand side and the method of the present invention on the right hand side.
Figure 18:
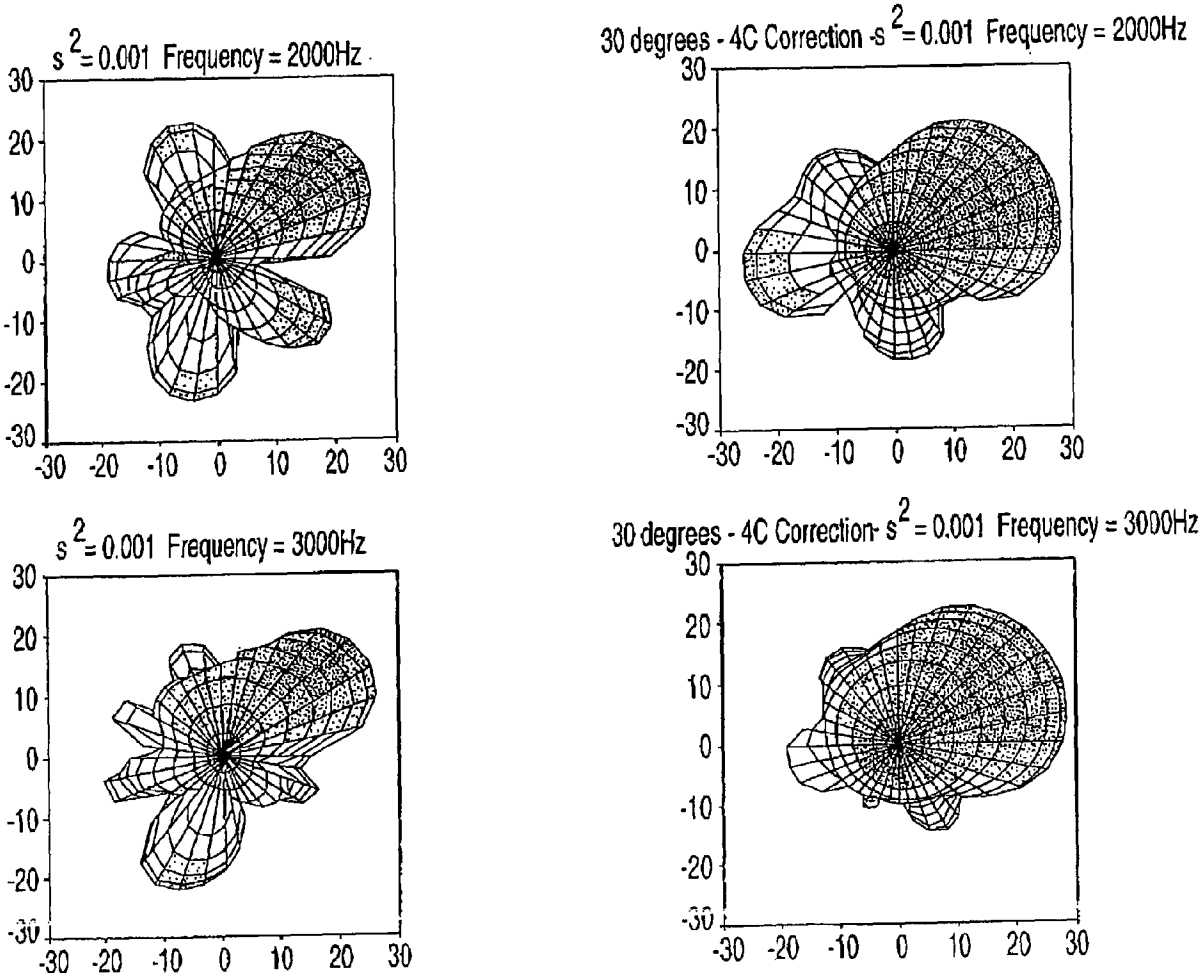
Figure 19:
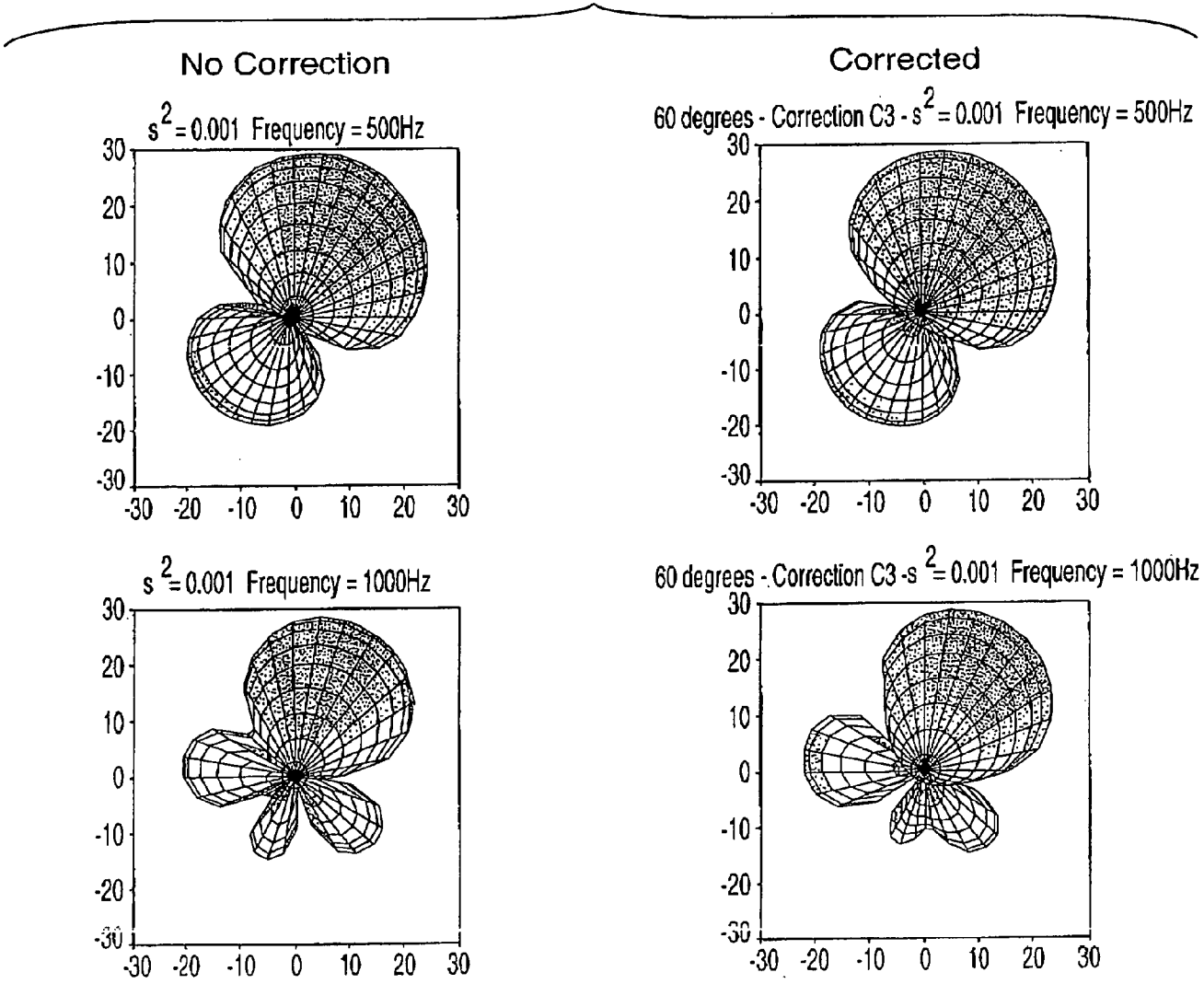
FIG. 19 illustrates beampattern variation vs. signal angle of arrival for the embedded elliptical array at 60° for 500, 1000, 2000 and 3000 Hz using the superdirective approach on the left hand side and the method of the present invention on the right hand side.
Figure 19:
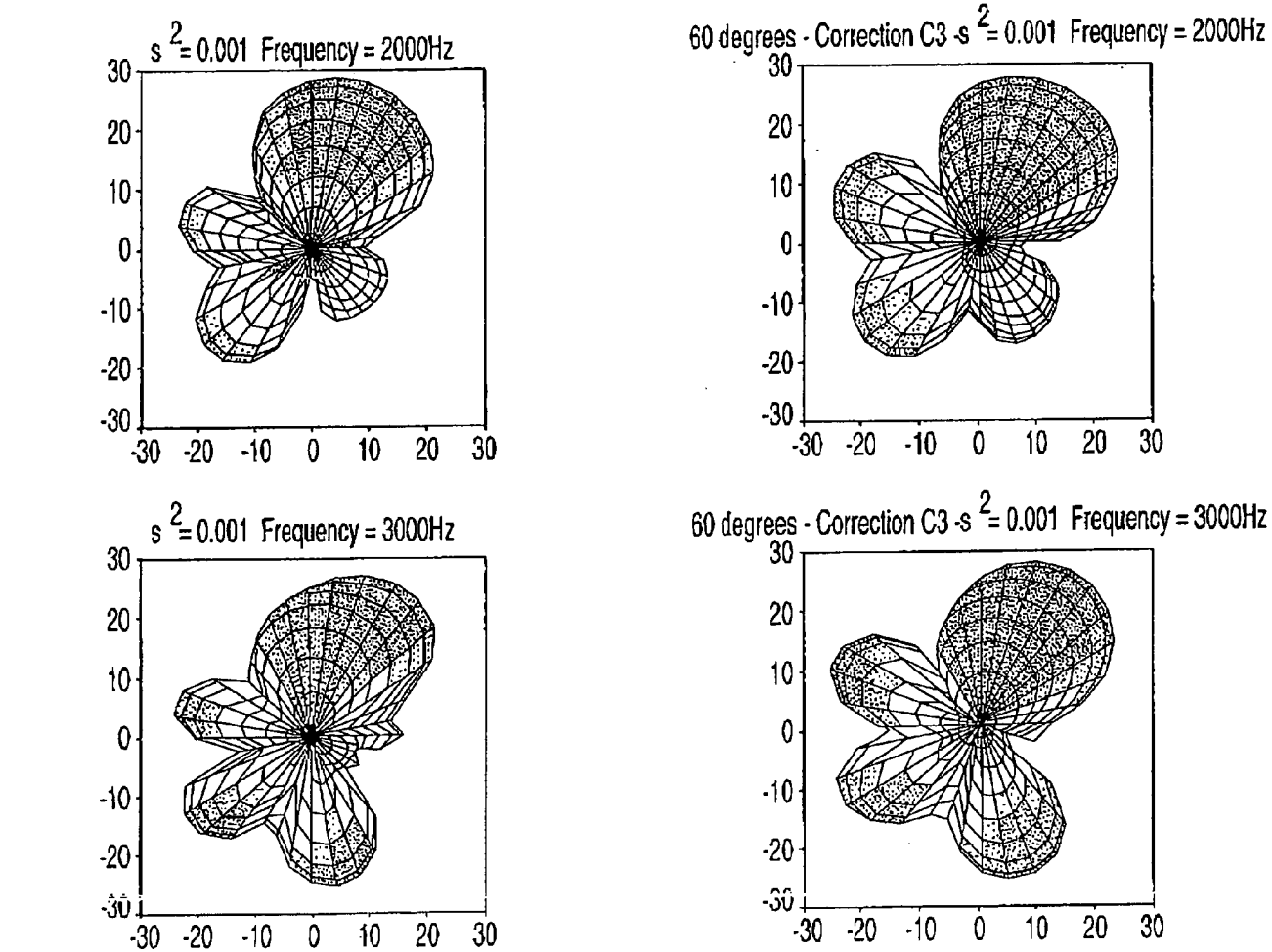
Figure 20:
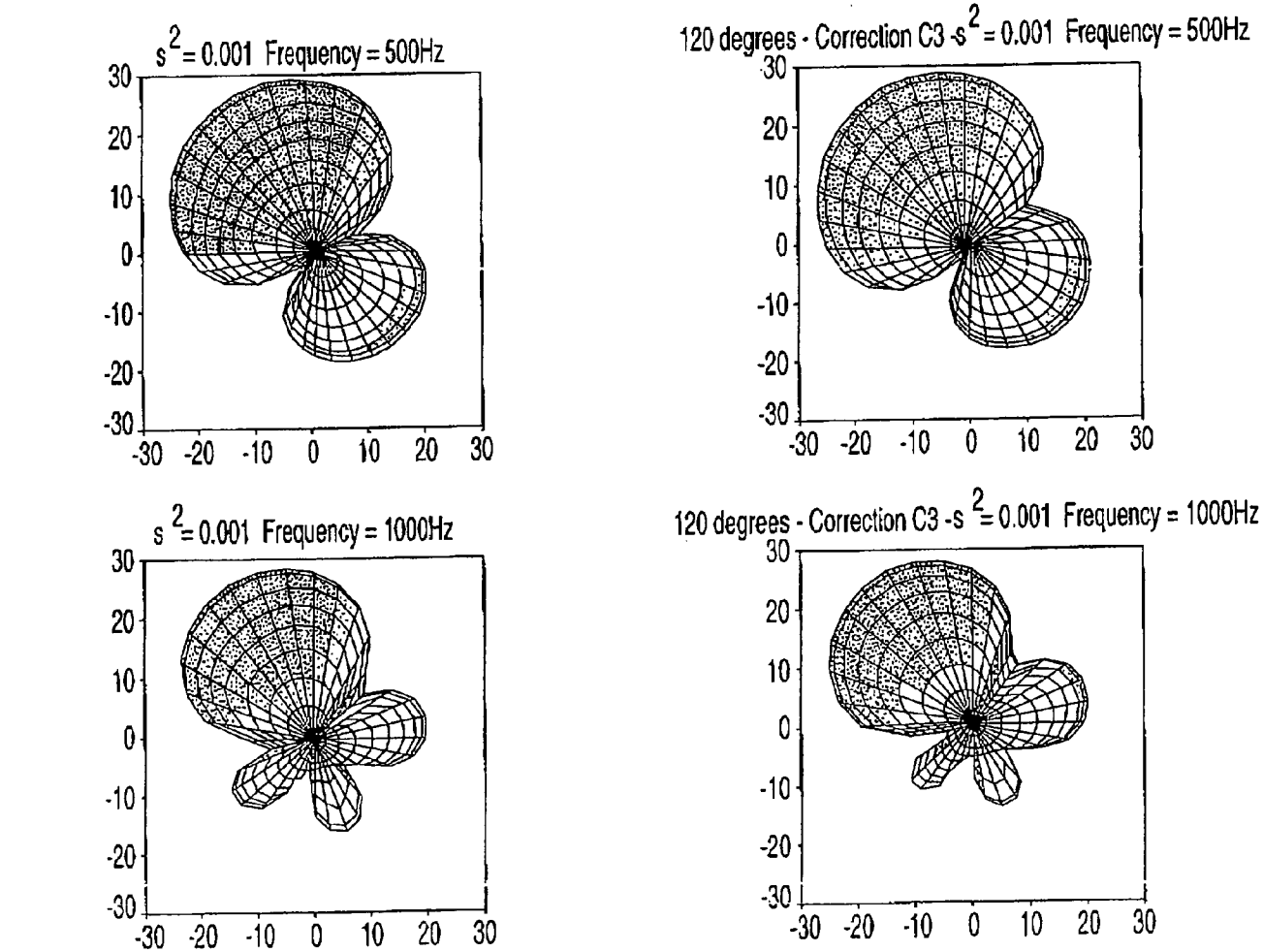
FIG. 20 illustrates beampattern variation vs. signal angle of arrival for the embedded elliptical array at 120° for 500, 1000, 2000 and 3000 Hz using the superdirective approach on the left hand side and the method of the present invention on the right hand side.
Figure 20:
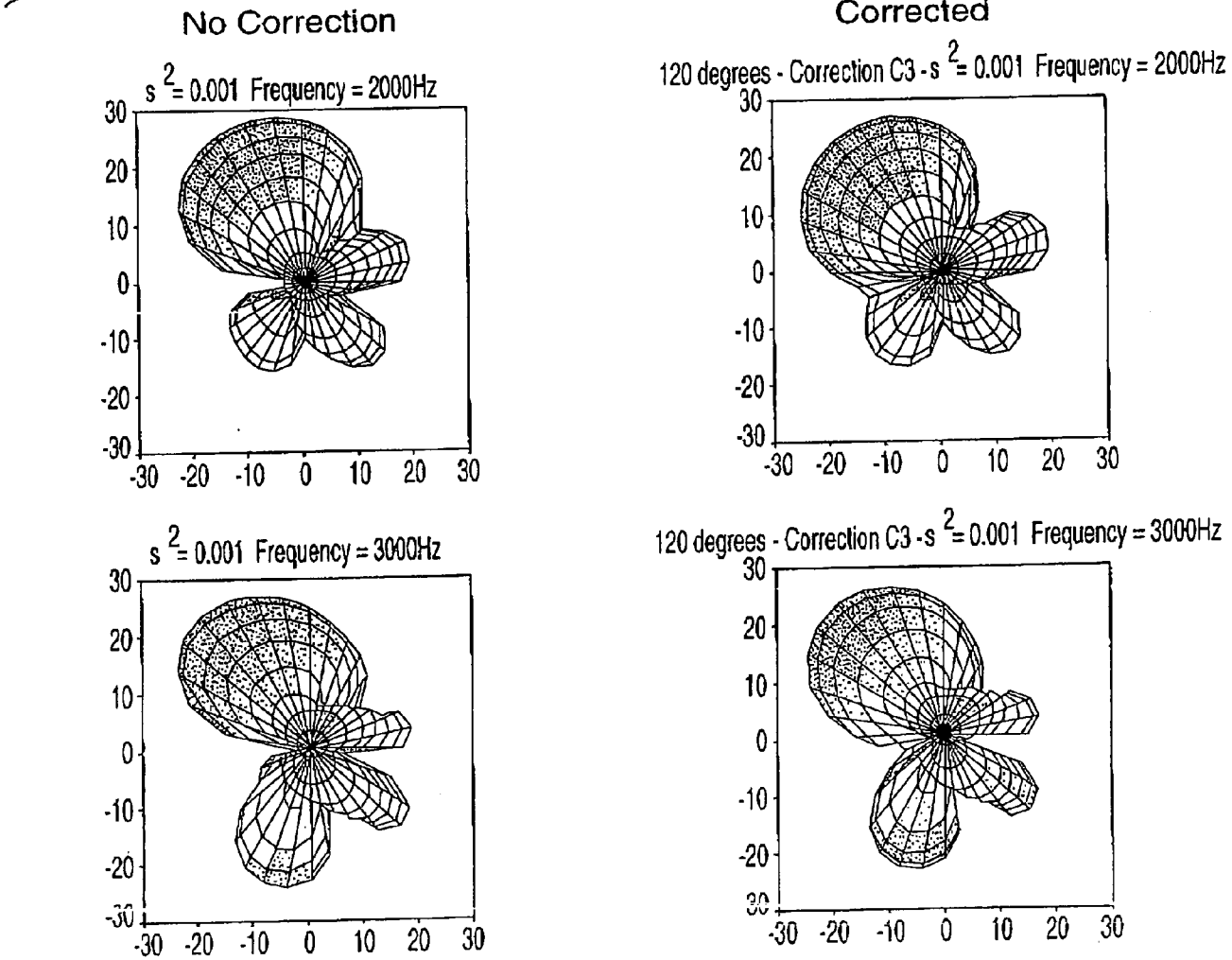

The left hand side of FIGS. 18, 19 and 20 shows the directivity obtained using the superdirective approach with $\sigma^2$=0.001 for 30° (FIG. 18), 60° (FIG. 19) and 120° (FIG. 20) at 500, 1000, 2000 and 3000 Hz. It will be noted from these that the beam directivity suffers from significant asymmetry, that the beam width narrows significantly at high frequencies and that the main lobe is not centred about the desired look direction. Another way to illustrate this result is to consider the attenuation ±30° from the desired look direction (at an elevation of 20°), as shown in FIG. 16. It will be noted that the attenuation varies quite significantly from about +1 dB to −25 dB, indicating significant asymmetry.

Figure 17:
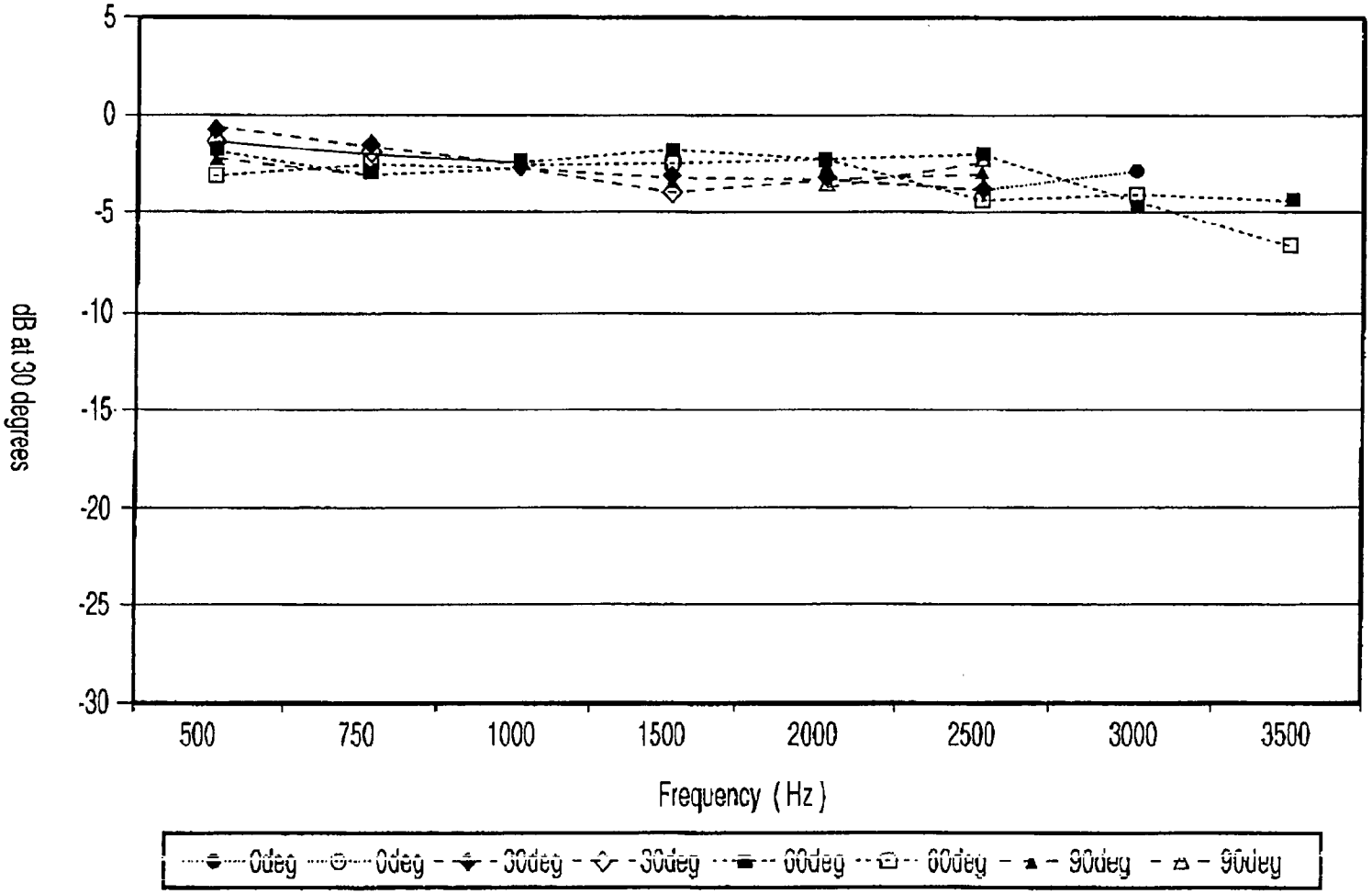
FIG. 17 shows beam pattern attenuation for the embedded elliptical array using the constrained method of the present invention at +/−30° from the look directions 0°, 30°, 60° and 90° for various frequencies between 500 Hz and 3500 Hz.

After application of the method according to the present invention, the results on the right hand side of FIGS. 18, 19 and 20 show correction of the beampattern and look direction at 30° (FIG. 18), 60° (FIG. 19) and 120° (FIG. 20) using the invention for various frequencies. FIG. 17 shows the attenuation ±30° from the desired look direction (at an elevation of 20°). Comparing FIG. 17 to FIG. 16 the improvement is obvious. The attenuation now varies by a few dB. There is still a narrowing of the beam at high frequencies but it is reasonably constant over the various look directions.

Modifications and variations of the invention are possible. The method is illustrated for the detection of one source, in a conference context for example, and is more oriented towards fixed beamforming approaches rather than adaptive ones. However, the principles of the invention may be extended to adaptive approaches: n which case the array geometry demands a correction of the beam pattern for each sector, and the storage of the correction vectors $d_{\theta+\theta_1}$ and $d_{\theta-\theta_j}$ as described in constraints (21), (22), (23). Also, although the disclosure describes optimisation for constant beam directivity it is possible to optimise for a maximum side lobe level or any other reasonable optimisation goal. All such variations and modifications are possible within the sphere and scope of the invention as defined hereto.

What is claimed is:

1. A beamformer for correcting the beam pattern and beamwidth of a microphone array embedded in an obstacle whose shape is not axi-symmetric, comprising:

a multiplier for multiplying a signal d of a sound source from a directivity angle θ to each respective microphone of said array by a respective weighting vector w to generate a product that enhances the signal d while minimising noise n, where n is not correlated to the signal d, and where n and d are both dependant upon frequency ω; and an adder for summing each respective product to generate an output signal such that $w_{opt}^{H}d=1$;

wherein optimised weighting vector $w_{opt}$ is a solution of $$\mathrm{Min}_w \frac{1}{2} w^H R_{nn} w$$

where $R_{nn}$ is a normalised noise correlation matrix, and wherein said solution is constrained by introducing symmetric vectors $d_{0+0_i}$ and $d_{0-0_i}$ on either side of d where $\theta_i>0$, with $i=\{1, \ldots, N_\theta\}$ is a set of directions belonging to directivity angle θ for increasing beamwidth of said array, and at least one further vector to correct for beam pattern asymmetry resulting from said obstacle having a shape that is non-axisymmetric.

2. The beamformer of claim 1, wherein said solution is constrained by a set of 2i ($i=\{1,2, \ldots, N_{const}\}$) linear constraints $w^H d_{\theta+\theta_1}=\alpha_i$ and $w^H d_{0-\theta_1}=\alpha_{-i}$ such that $$\mathrm{Min}_w \frac{1}{2} w^H R_{nn} w \text{ subject to } w^H d = 1$$

under constraint becomes:

$$\mathrm{Min}_w \frac{1}{2} w^H R_{nn} w \text{ subject to } C^H w = g$$

where C is a rectangular matrix defined by:

$$C=[d|d_{\theta+\theta_1}|d_{\theta-\theta_i}| \ldots ]$$

and g is a vector defined by:

$$g = \begin{bmatrix} 1 \\ \alpha_i \\ \alpha_{-i} \\ \vdots \end{bmatrix}$$

resulting in said optimised weight vector $w_{opt}$ being given by:

$$w_{opt}=R_{nn}^{-1}C[C^H R_{nn} C]^{-1} g.$$

3. The beamformer of claim 1, wherein said solution is constrained by a set of quadratic constraints whereby $d_{0+0_i}$ and $d_{\theta-\theta_i}$ are used to build a cross-correlation matrix:

$$D_{\theta_1}=d_{\theta+\theta_i} d_{\theta+\theta_1}{}^H + d_{\theta-i} d_{0-\theta_i}{}^H$$

and the quadratic constraints are defined as:

$$w^H D_{\theta_i} w=\beta_i$$

where $\beta_i$ is a set of values required for $w^H D_{\theta_1} w$, resulting in said optimised weight vector $w_{opt}$ being a minimisation of:

$$J(w, \lambda, \lambda_2) = \frac{1}{2} w^H R_{nn} w + \lambda(1 - w^H d) + \sum_i \lambda_i(\beta_i - w^H D_{\theta_i} w) + \sigma^2(\gamma - w^H w)$$

where Lagrange coefficients $\lambda, \lambda_1$, are dependant on frequency $\omega$.

4. The beamformer of claim 2, wherein said at least one further vector is a single vector $d_{\theta\pm\theta_i}$, and wherein angle $\theta_j$ is chosen in the direction of the asymmetry.

5. The beamformer of claim 2, wherein said at least one further vector is a pair of vectors $d_{\theta+\theta_i}$ and $d_{0-0_i}$ (with $\theta_j \neq \theta_i$), such that a set of linear constraints $w^H(d_{\theta+\theta_j} - d_{\theta-\theta_1})=0$ with $\theta_j \neq \theta_i$ is defined irrespective of $w^H d_{\theta\pm\theta_i}=\alpha_i$.

6. The beamformer of claim 4, wherein the cross-correlation matrix associated with said single vector is $D_{\theta_i}=d_{\theta\pm\theta_i} d_{\theta\pm\theta_i}{}^H$.

7. The beamformer of claim 5, wherein the cross-correlation matrix associated with said pair of vectors is $D_{\theta_1}=d_{\theta+\theta_1} d_{\theta+\theta_i}{}^H + d_{\theta-\theta_1} d_{\theta-\theta_i}{}^H$ for a pair of symmetric ($\theta_j=\theta_i$) vectors or asymmetric ($\theta_j \neq \theta_i$) vectors.

8. A method for correcting the beam pattern and beamwidth of a microphone array embedded in an obstacle whose shape is not axi-symmetric, comprising:

positioning respective microphones of said array at selected locations on said obstacle such that the distance between microphones is less than one half of $\lambda/2$, where $\lambda$ represents wavelength;

for each said microphone calculating a weighting vector w such that the Hermitian product $w_{opt}{}^H d=1$ enhances the signal d of a sound source for a given signal angle of arrival $\theta$ while minimising noise n due to the environment, where n is not correlated to the signal d, and where n and d are both dependant upon frequency $\omega$;

wherein optimised weighting vector $w_{opt}$ is a solution of $$\mathrm{Min}_w \frac{1}{2} w^H R_{nn} w \text{ subject to } w^H d = 1,$$

where $R_{nn}$ is a normalised noise correlation matrix, and wherein said solution is constrained by introducing symmetric vectors $d_{\theta+\theta_i}$ and $d_{\theta-\theta_i}$ on either side of d where $\theta_i>0$, with $i=\{1, \ldots N_\theta\}$ is a set of directions belonging to directivity angle $\theta$ for increasing beamwidth of said array, and at least one further vector to correct for beam pattern asymmetry resulting from said obstacle having a shape that is non-axisymmetric.

9. The method of claim 8, wherein said solution is constrained by a set of 2i ($i=\{1, 2, \ldots N_{const}\}$) linear constraints $w^H d_{\theta+\theta_i}=\alpha_i$ and $w^H d_{\theta-\theta_1}=\alpha_{-i}$ such that $$\mathrm{Min}_w \frac{1}{2} w^H R_{nn} w \text{ subject to } w^H d = 1$$

under constraint becomes:

$$\mathrm{Min}_w \frac{1}{2} w^H R_{nn} w \text{ subject to } C^H w = g$$

where C is a rectangular matrix defined by:

$$C=[d|d_{\theta+\theta_i}|d_{\theta-\theta_i}| \ldots ]$$

and g is a vector defined by:

$$g = \begin{bmatrix} 1 \\ \alpha_i \\ \alpha_{-i} \\ \vdots \end{bmatrix}$$

resulting in said optimised weight vector $w_{opt}$ being given by;

$$w_{opt}=R_{nn}^{-1}C[C^H R^{nn} C]^{-1} g.$$

10. The method of claim 9, wherein said solution is constrained by a set of quadratic constraints whereby $d_{\theta+\theta_1}$ and $d_{\theta-\theta_1}$ are used to build a cross-correlation matrix:

$$D_{\theta_i}=d_{\theta+\theta_i} d_{\theta+\theta_i}{}^H + d_{\theta-\theta_i} d_{\theta-\theta_i}{}^H$$

and the quadratic constraints are defined as:

$$w_H D_{0_i} w=\beta_i$$

where $\beta_i$ is a set of values required for $w^H D_{\theta_i} w$, resulting in said optimised weight vector $w_{opt}$ being a minimisation of:

$$J(w, \lambda, \lambda_2) = \frac{1}{2} w^H R_{nn} w + \lambda(1 - w^H d) + \sum_i \lambda_i(\beta_i - w^H D_{\theta_i} w) + \sigma^2(\gamma - w^H w)$$

where Lagrange coefficients $\lambda, \lambda_i$ are dependant on frequency $\omega$.

11. The method of claim 9, wherein said at least one further vector is a single vector $d_{\theta \pm \theta_j}$, and wherein the angle $\theta_j$ is chosen in the direction of the asymmetry.

12. The method of claim 9, wherein said solution is further constrained by introducing at least a pair of vectors $d_{\theta+\theta_j}$ and $d_{\theta-\theta_j}$ with $\theta_j \neq \theta_i$) to correct for beam pattern asymmetry resulting from said obstacle having a shape that is non-axisymmetric and re-orient the beam, such that a set of linear constraints $w^H(d_{\theta+\theta_j} - d_{\theta-\theta_i}) = 0$ with $\theta_j \neq \theta_i$ of is defined irrespective of $w^H d_{\theta \pm \theta_j} = \alpha_i$.

13. The method of claim 11, wherein the cross-correlation matrix associated with said single vector is $D_{\theta_j} = d_{\theta \pm \theta_j} d_{\theta \pm \theta j}^H$.

14. The method of claim 12, wherein the cross-correlation matrix associated with said pair of vectors is $D_{\theta_i} = d_{0+\theta 1} d_{\theta+\theta_1}^H + d_{\theta-\theta_j} d_{\theta-\theta_j}^H$ for a pair of symmetric ($\theta_j = \theta_i$) vectors or asymmetric ($\theta_j \neq \theta_1$) vectors.

15. A method of designing a broad band constant directivity beamformer for a non-linear and non-axi-symmetric sensor array embedded in an obstacle, comprising:

applying a numerical method to said obstacle to generate a boundary elements mesh;

positioning array sensors at selected nodes of the boundary element mesh for defining sectors all around the array, modelling a set of potential sources to be detected by said sensors in said sectors and determining the acoustic pressure at each of said sensors for each of said sources;

defining a noise field characterised by a normalized noise correlation matrix ($R_{nn}$) at said array sensors;

for each sector, with a look direction $\theta$, defining (i) a pair of vectors whose directions are symmetric relative to direction $\theta$, and at least one of (ii) a pair of vectors whose directions are asymmetric relative to direction $\theta$, and (iii) a single vector with a direction different from $\theta$, and applying a set of constraints to said vectors in each sector to obtain an optimal weighting vector $w_{opt}$ for correction of beamwidth and beampattern asymmetry.

* * * * *